US008878043B2

(12) United States Patent
Cheever et al.

(10) Patent No.: US 8,878,043 B2
(45) Date of Patent: Nov. 4, 2014

(54) SYSTEMS, METHODS, AND APPARATUS FOR MUSIC COMPOSITION

(71) Applicant: uSOUNDit Partners, LLC, San Antonio, TX (US)

(72) Inventors: Jean Cheever, San Antonio, TX (US); Tom Polum, New York, NY (US); Tamra Hayden-Rice, Lakewood, CO (US)

(73) Assignee: uSOUNDit Partners, LLC, San Antonio, TX (US)

( * ) Notice: Subject to any disclaimer, the term of this patent is extended or adjusted under 35 U.S.C. 154(b) by 0 days.

(21) Appl. No.: 14/022,515

(22) Filed: Sep. 10, 2013

(65) Prior Publication Data

US 2014/0069262 A1 Mar. 13, 2014

Related U.S. Application Data

(60) Provisional application No. 61/698,807, filed on Sep. 10, 2012.

(51) Int. Cl.
*G10H 1/18* (2006.01)
*G10H 1/38* (2006.01)

(52) U.S. Cl.
USPC ..... 84/609; 84/615; 84/613; 84/649; 84/653; 84/669

(58) Field of Classification Search
USPC ..... 84/609, 612, 613, 615, 636, 637, 649, 84/652, 653, 668, 669
See application file for complete search history.

(56) References Cited

U.S. PATENT DOCUMENTS

| | | | | |
|---|---|---|---|---|
| 6,011,212 | A | 1/2000 | Rigopulos et al. | |
| 6,738,698 | B2 | 5/2004 | Ichihara et al. | |
| 6,801,852 | B2 | 10/2004 | Takahashi et al. | |
| 7,135,635 | B2 * | 11/2006 | Childs et al. | 84/600 |
| 7,138,575 | B2 * | 11/2006 | Childs et al. | 84/615 |
| 7,297,859 | B2 * | 11/2007 | Ueki et al. | 84/613 |
| 7,314,993 | B2 * | 1/2008 | Nishitani et al. | 84/612 |
| 7,465,866 | B2 * | 12/2008 | Ueki et al. | 84/613 |
| 7,511,213 | B2 * | 3/2009 | Childs et al. | 84/615 |
| 7,629,528 | B2 * | 12/2009 | Childs et al. | 84/609 |

(Continued)

FOREIGN PATENT DOCUMENTS

| | | |
|---|---|---|
| JP | 2009289244 | 12/2009 |
| WO | WO2007081519 | 7/2007 |

OTHER PUBLICATIONS

Nickolaidis, Ryan John "A Generative Model of Tonal Tension and its Application in dynamic Realtime Sonification" College of Architecture Theses and Dissertations; Jul. 18, 2011; 84 pages; Georgia Institute of Technology.

(Continued)

*Primary Examiner* — David S. Warren
(74) *Attorney, Agent, or Firm* — Michael D. Downs; Fincham Downs, LLC

(57) ABSTRACT

Systems, apparatus, methods, and articles of manufacture provide for determining one or more chords and/or music notes to output (e.g., via a mobile device) based on a direction of movement and/or a speed of movement (e.g., of a mobile device). In some embodiments, determining a music note for output may comprise determining whether a speed of a mobile device has increased, decreased, or remained constant.

20 Claims, 11 Drawing Sheets

(56) References Cited

U.S. PATENT DOCUMENTS

| | | | | |
|---|---|---|---|---|
| 7,737,353 | B2 * | 6/2010 | Sasaki et al. | 84/612 |
| 7,741,554 | B2 | 6/2010 | Sasaki et al. | |
| 7,960,638 | B2 | 6/2011 | Miyajima et al. | |
| 8,003,874 | B2 * | 8/2011 | Asakura et al. | 84/613 |
| 8,155,343 | B2 * | 4/2012 | Honji et al. | 381/86 |
| 8,247,677 | B2 * | 8/2012 | Ludwig | 84/622 |
| 8,309,833 | B2 * | 11/2012 | Ludwig | 84/600 |
| 8,440,902 | B2 * | 5/2013 | Ludwig | 84/622 |
| 8,566,021 | B2 * | 10/2013 | Smartt | 701/409 |
| 8,586,852 | B2 * | 11/2013 | Tsuji | 84/741 |
| 8,589,067 | B2 * | 11/2013 | Asakawa et al. | 701/431 |
| 8,618,405 | B2 * | 12/2013 | Tansley | 84/645 |
| 8,620,643 | B1 * | 12/2013 | Ludwig | 704/200.1 |
| 2002/0166439 | A1 * | 11/2002 | Nishitani et al. | 84/600 |
| 2002/0170413 | A1 * | 11/2002 | Nishitani et al. | 84/600 |
| 2003/0070537 | A1 * | 4/2003 | Nishitani et al. | 84/633 |
| 2004/0044291 | A1 * | 3/2004 | Yasushi et al. | 600/509 |
| 2004/0055447 | A1 * | 3/2004 | Childs et al. | 84/615 |
| 2004/0112203 | A1 * | 6/2004 | Ueki et al. | 84/613 |
| 2004/0174431 | A1 * | 9/2004 | Stienstra | 348/155 |
| 2005/0016362 | A1 * | 1/2005 | Nishitani et al. | 84/612 |
| 2005/0055267 | A1 * | 3/2005 | Chasanoff et al. | 705/10 |
| 2005/0240396 | A1 * | 10/2005 | Childs et al. | 704/207 |
| 2006/0111621 | A1 * | 5/2006 | Coppi et al. | 600/300 |
| 2006/0155751 | A1 * | 7/2006 | Geshwind et al. | 707/102 |
| 2006/0174291 | A1 | 8/2006 | Takai et al. | |
| 2006/0247995 | A1 * | 11/2006 | Childs et al. | 705/35 |
| 2007/0071256 | A1 | 3/2007 | Ito | |
| 2007/0074617 | A1 | 4/2007 | Vergo | |
| 2007/0131097 | A1 * | 6/2007 | Lu et al. | 84/615 |
| 2007/0270667 | A1 * | 11/2007 | Coppi et al. | 600/300 |
| 2008/0192954 | A1 * | 8/2008 | Honji et al. | 381/86 |
| 2008/0289477 | A1 * | 11/2008 | Salter | 84/477 R |
| 2009/0000463 | A1 * | 1/2009 | Childs et al. | 84/615 |
| 2010/0294112 | A1 * | 11/2010 | Asakura et al. | 84/613 |
| 2010/0305732 | A1 | 12/2010 | Serletic | |
| 2010/0318512 | A1 * | 12/2010 | Ludwig | 707/722 |
| 2011/0030533 | A1 * | 2/2011 | Piccionelli et al. | 84/422.4 |
| 2011/0035033 | A1 * | 2/2011 | Friedenberger | 700/94 |
| 2011/0061515 | A1 * | 3/2011 | Turner | 84/612 |
| 2011/0072955 | A1 * | 3/2011 | Turner | 84/612 |
| 2011/0087426 | A1 * | 4/2011 | Feng | 701/200 |
| 2011/0121954 | A1 * | 5/2011 | Steger et al. | 340/407.1 |
| 2011/0148884 | A1 * | 6/2011 | Zeleny | 345/441 |
| 2011/0191674 | A1 * | 8/2011 | Rawley et al. | 715/702 |
| 2011/0206217 | A1 * | 8/2011 | Weis | 381/74 |
| 2011/0206354 | A1 * | 8/2011 | Omura | 386/343 |
| 2011/0264708 | A1 * | 10/2011 | Smartt | 707/803 |
| 2011/0308376 | A1 * | 12/2011 | Ludwig | 84/604 |
| 2012/0006181 | A1 | 1/2012 | Hanada et al. | |
| 2012/0076212 | A1 | 3/2012 | Zeppetelle et al. | |
| 2012/0095675 | A1 * | 4/2012 | Tom et al. | 701/425 |
| 2012/0136569 | A1 * | 5/2012 | Asakawa et al. | 701/431 |
| 2012/0148066 | A1 * | 6/2012 | Honji et al. | 381/86 |
| 2012/0174735 | A1 | 7/2012 | Little et al. | |
| 2012/0185163 | A1 * | 7/2012 | Boschker et al. | 701/411 |
| 2012/0198985 | A1 * | 8/2012 | Ludwig | 84/604 |
| 2012/0254223 | A1 * | 10/2012 | Jotanovic et al. | 707/769 |
| 2012/0260790 | A1 * | 10/2012 | Ludwig | 84/604 |
| 2012/0269344 | A1 * | 10/2012 | VanBuskirk | 380/255 |
| 2012/0311508 | A1 * | 12/2012 | Fleizach | 715/863 |
| 2013/0091437 | A1 * | 4/2013 | Ludwig | 715/751 |
| 2013/0152768 | A1 * | 6/2013 | Rapp | 84/634 |
| 2013/0205976 | A1 * | 8/2013 | Ludwig | 84/606 |
| 2013/0228063 | A1 * | 9/2013 | Turner | 84/612 |
| 2013/0228064 | A1 * | 9/2013 | Turner | 84/612 |
| 2013/0312589 | A1 * | 11/2013 | MacPherson | 84/612 |
| 2014/0018097 | A1 * | 1/2014 | Goldstein | 455/456.1 |
| 2014/0069262 | A1 * | 3/2014 | Cheever et al. | 84/613 |
| 2014/0107916 | A1 * | 4/2014 | Urup et al. | 701/425 |

OTHER PUBLICATIONS

Francois et al. "Mimi4x: An Interactive Audio-Visual Installation for High-Level Structural Improvisation" Multimedia and Expo (ICME), 2010 IEEE International Conference on; Jul. 19-23, 2010; pp. 1618-1623.

Website: "Circle of Fifths" (http://en.wikipedia.org/w/index.php?oldid=571545410) Download date: Sep. 26, 2013; 10 pages.

* cited by examiner

SYSTEMS, METHODS, AND APPARATUS FOR MUSIC COMPOSITION

CROSS-REFERENCE TO RELATED APPLICATIONS

This application claims the benefit of priority U.S. Provisional Patent Application No. 61/698,807, entitled "SYSTEMS, METHODS AND APPARATUS FOR MUSIC COMPOSITION," filed Sep. 10, 2012. The entire contents of the application identified above are incorporated by reference in this application.

BRIEF DESCRIPTION OF THE DRAWINGS

An understanding of embodiments described in this disclosure and many of the attendant advantages may be readily obtained by reference to the following detailed description when considered with the accompanying drawings, of which.

DETAILED DESCRIPTION

Figure 1A:
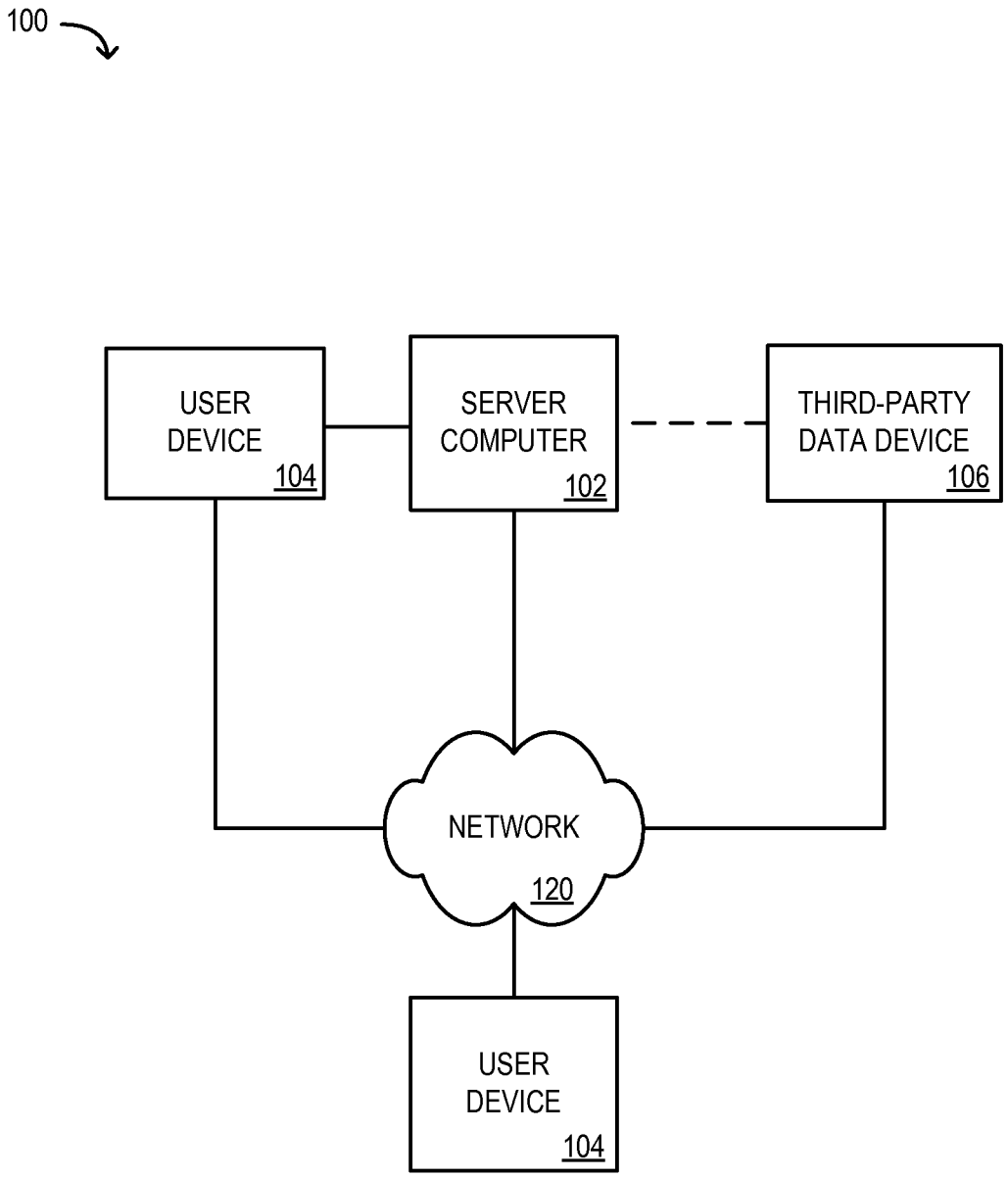
FIG. 1A is a diagram of a system according to some embodiments.

This disclosure, in accordance with some embodiments, relates generally to systems, apparatus, media, and methods for generating compositions of music. In particular, this disclosure describes, with respect to one or more embodiments, systems, apparatus, media, and methods for determining music keys, music chords, and/or music notes based on information about movement of a user and/or a user device (e.g., information about a device's speed and/or direction of movement or travel). Some embodiments provide for determining a sequence of music notes (e.g., a melody), based on movement information, that is pleasing to users.

This disclosure, in accordance with some embodiments, relates generally to systems, apparatus, media, and methods for generating and/or outputting audio signals. In particular, this disclosure describes, with respect to one or more embodiments, systems, apparatus, media, and methods for determining and/or outputting audio signals based on movement data (e.g., information about a device's speed and/or direction of travel).

Applicants have recognized that, in accordance with some embodiments described in this disclosure, some types of users may find it beneficial to be able to generate music (e.g., melodies, chords) based on the user's speed and/or direction of movement (e.g., as indicated or determined via a computer software application running on a tablet computer or other type of mobile computing device).

In accordance with some embodiments of the present invention, one or more systems, apparatus, methods, articles of manufacture, and/or (transitory or non-transitory) computer readable media (e.g., a non-transitory computer readable memory storing instructions for directing a processor) provide for one or more of: determining a direction of travel; determining a speed of travel; and determining at least one music note (e.g., a music tone) based on the direction of travel and/or the speed of travel.

In accordance with some embodiments of the present invention, one or more systems, apparatus, methods, articles of manufacture, and/or computer readable media provide for one or more of: storing an indication of at least one determined music note (e.g., a plurality of music notes arranged in a determined sequence); determining a time at which and/or a frequency at which to play one or more music notes (e.g., based on a speed of travel and/or a direction of travel); recording generated audio (e.g., storing a recorded music file including a plurality of tones corresponding to movement of user) and/or transmitting, sharing, or otherwise outputting an audio signal that is based on one or more determined music notes (e.g., outputting a melody and/or chords via a speaker of a mobile device).

In accordance with some embodiments of the present invention, a software application (which may be referred to in this disclosure as a music generator application) allows a user with a mobile device to create music by moving (e.g., running, walking, jogging). Created music may include, for example, one or more chords and/or music notes generated based on and/or in response to information about location, direction, navigational heading or compass heading, and/or speed of a user, and/or any changes in such information (e.g., a change in direction or speed of travel).

As used in this disclosure, "movement" and "travel" are used synonymously and may refer to, without limitation, any movement, travel, or journey of a person and/or object (e.g., a mobile device), of any distance. Such movement may comprise, for example, movement of an object or person from one point or place to another (e.g., during the process of going for a walk, run, or bike ride), a change in position or orientation, and/or a change in geographic location. In one example, movement may comprise movement of an object even if a user remains relatively fixed in position (e.g., sitting or standing), if the user is moving the object (e.g., a smartphone held by a user may be traveling from one position to another by the user moving his hand holding the smartphone).

As used in this disclosure, "computing device" may refer to, without limitation, one or more personal computers, laptop computers, set-top boxes, cable boxes, network storage devices, server computers, media servers, personal media devices, communications devices, display devices, vehicle or dashboard computer systems, televisions, stereo systems, video gaming systems, gaming consoles, cameras, video cameras, MP3 players, mobile devices, mobile telephones, cellular telephones, GPS navigation devices, smartphones, tablet computers, portable video players, satellite media players, satellite telephones, wireless communications devices, and/or personal digital assistants (PDA).

According to some embodiments, a "user device" may comprise one or more types of computing devices that may be used by an end user. Some types of users may find it beneficial to use a mobile device controlled (e.g., by a processor executing computer software application instructions) in accordance with one or more of the embodiments described in this disclosure. In one example, a user device may comprise a smartphone or other personal mobile device. Other types of computing devices that may be used as user devices are discussed in this disclosure, and still others suitable for various embodiments will be apparent to those of ordinary skill in light of this disclosure.

As used in this disclosure, "mobile device" and "portable device" may refer to, without limitation, mobile telephones, cellular telephones, laptop computers, GPS navigation devices, smartphones such as a Blackberry, Palm, Windows 7, iPhone, Galaxy Nexus, or Droid phone, tablet computers such as an iPad by Apple, Slate by HP, Ideapad by Lenovo, Xoom by Motorola, Kindle Fire HD by Amazon, Note II by Samsung, or Nexus 7 by Google, a handheld computer, a wearable computer, a personal digital assistant, a cellular telephone, a network appliance, a camera, a smartphone, a network base station, a media player, a navigation device, a game console, a tablet computer, a laptop computer, or any combination of any two or more of such computing devices.

It should be understood that the embodiments described in this disclosure are not limited to use with mobile devices (although some preferred embodiments are described with reference to such devices, for ease of understanding), but are equally applicable to any network device, user device, or other computing device, such as a personal desktop computer with a browser application and Internet access (e.g., in a user's home or office). Any embodiments described with reference to a mobile device in this disclosure should be understood to be equally applicable to any such other types of computing device, as deemed appropriate for any particular implementation(s).

FIG. 1A depicts a block diagram of an example system 100 according to some embodiments. The system 100 may comprise one or more user devices 104 in communication with a controller or server computer 102 (that may also be or comprise a user device, in accordance with some embodiments) via a network 120. Typically a processor (e.g., one or more microprocessors, one or more microcontrollers, one or more digital signal processors) of a user device 104 or server computer 102 will receive instructions (e.g., from a memory or like device), execute those instructions, and perform one or more processes defined by those instructions. Instructions may be embodied, for example, in one or more computer programs and/or one or more scripts.

In some embodiments a server computer 102 and/or one or more of the user devices 104 stores and/or has access to information useful for performing one or more functions described in this disclosure. Such information may include one or more of: (i) movement data (e.g., associated with a user and/or a user device), such as, without limitation, one or more indications of direction of travel, speed of travel, orientation (e.g., of a mobile device), and/or position information (e.g., GPS coordinates); (ii) settings data, such as, without limitation, user-provided and/or application-provided data relating to information about a user and/or settings (e.g., a chord setting, a music style) for use in generating audio signals based on movement data; and/or (iii) music data, such as, without limitation, one or more music notes or tones, music chords, music keys, sequences of music notes (e.g., a melody), audio signals, and/or music recordings (e.g., created based on a user's movement using a smartphone application).

According to some embodiments, any or all of such data may be stored by or provided via one or more optional third-party data devices 106 of system 100. A third-party data device 106 may comprise, for example, an external hard drive and/or flash drive connected to a server computer 102, a remote third-party computer system for storing and serving data for use in performing one or more functions described in this disclosure, or a combination of such remote and/or local data devices. In one embodiment, one or more companies and/or end users may subscribe to or otherwise purchase data (e.g., premium settings and/or content data) from a third party and receive the data via the third-party data device 106.

In some embodiments, the server computer 102 may comprise one or more electronic and/or computerized controller devices such as computer servers communicatively coupled to interface with the user devices 104 and/or third-party devices 106 (directly and/or indirectly). The server computer 102 may, for example, comprise PowerEdge™ M910 blade servers manufactured by Dell, Inc. of Round Rock, Tex. which may include one or more Eight-Core Intel® Xeon® 7500 Series electronic processing devices. According to some embodiments, the server computer 102 may be located remote from the user devices 104. The server computer 102 may also or alternatively comprise a plurality of electronic processing devices located at one or more various sites and/or locations.

According to some embodiments, the server computer 102 may store and/or execute specially programmed instructions to operate in accordance with one or more embodiments described in this disclosure.

The server computer 102 may, for example, execute one or more programs that facilitate determining, transmitting, and/or receiving movement data, settings data, music data and/or other data items via the network 120 (e.g., to/from one or more users).

In some embodiments, a user device 104 may comprise a desktop computer (e.g., a Dell OptiPlex™ desktop by Dell, Inc.) or a workstation computer (e.g., a Dell Precision™ workstation by Dell Inc.), and/or a mobile or portable computing device, and an application for generating audio based on digital image files is stored locally on the user device 104, which may access information (e.g., settings data) stored on, or provided via, the server computer 102. In another embodiment, the server computer 102 may store some or all of the program instructions for generating audio based on movement data, and the user device 104 may execute the application remotely via the network 120 and/or download from the server computer 102 (e.g., a web server) some or all of the program code for executing one or more of the various functions described in this disclosure.

In one embodiment, a server computer may not be necessary or desirable. For example, some embodiments described in this disclosure may be practiced on one or more devices without a central authority. For instance, a mobile device may store and execute a stand-alone music generator application (e.g., downloaded from an on-line application store). In such an embodiment, any functions described in this disclosure as performed by a server computer and/or data described as stored on a server computer may instead be performed by or stored on one or more other types of devices, such as a mobile device or tablet computer. Additional ways of distributing information and program instructions among one or more user devices 104 and/or server computers 102 will be readily understood by one skilled in the art upon contemplation of the present disclosure.

Figure 1B:
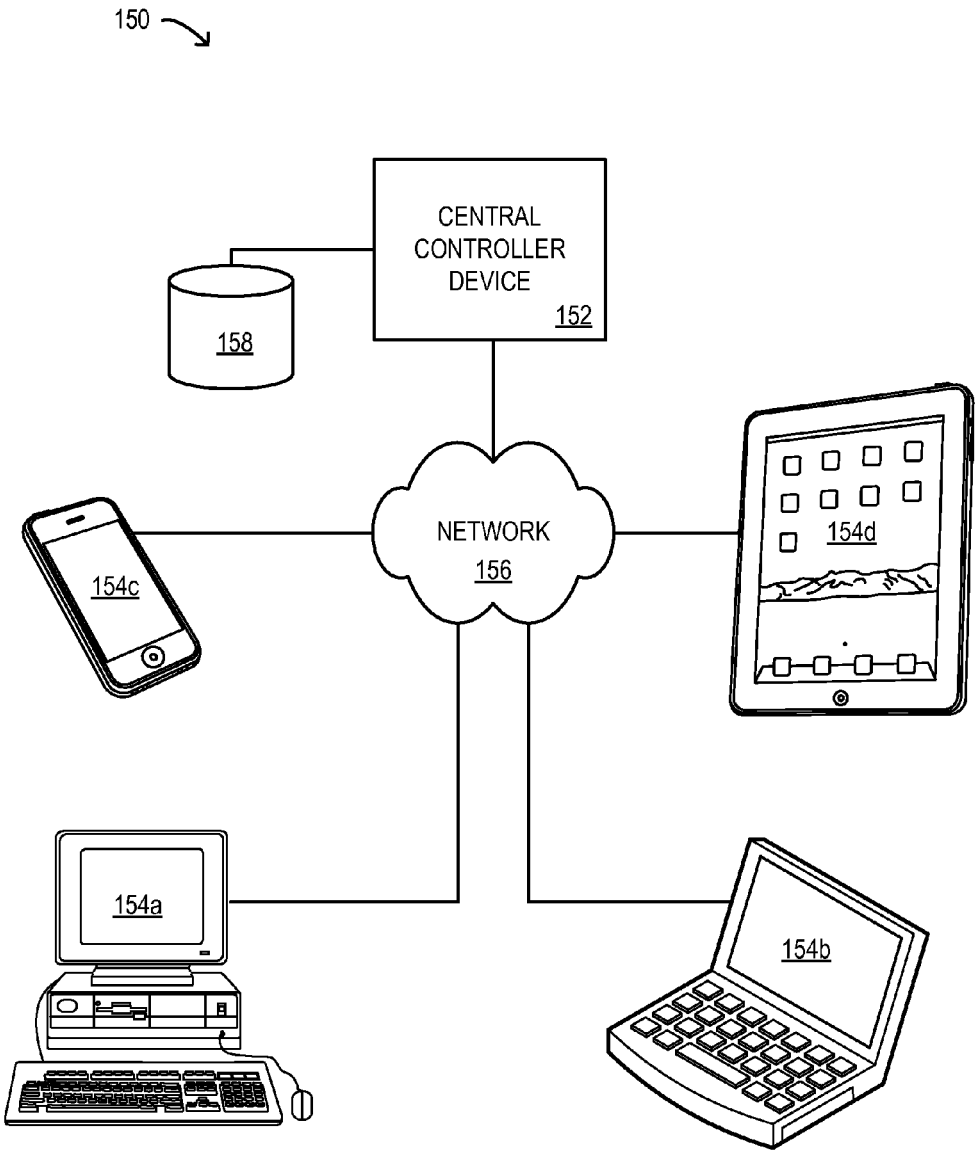
FIG. 1B is a diagram of a system according to some embodiments.

FIG. 1B depicts a block diagram of an example system 150 according to some embodiments. The system 150 may comprise one or more user devices 154*a-d* in communication with a controller device 152 via a network 156. According to some embodiments, the controller device 152 may be in communication with one or more databases 158.

In some embodiments, the controller device 152 may comprise one or more electronic and/or computerized controller devices such as computer servers communicatively coupled to interface with the user devices 154*a-d* (directly and/or indirectly). The controller device 152 may, for example, comprise one or more devices as discussed with respect to server computer 102. According to some embodiments, the controller device 152 may be located remote from the user devices 154*a-d*. The controller device 152 may also or alternatively comprise a plurality of electronic processing devices located at one or more various sites and/or locations.

The user devices 154*a-d*, in some embodiments, may comprise any types or configurations of mobile electronic network, user, and/or communication devices that are or become known or practicable. User devices 154*a-d* may, for example, comprise cellular and/or wireless telephones such as an iPhone® manufactured by Apple, Inc. of Cupertino, Calif. or Optimus™ S smart phones manufactured by LG® Electronics, Inc. of San Diego, Calif., and running the Android® operating system from Google, Inc. of Mountain View, Calif. The user device 154*a* may, as depicted for example, comprise a personal or desktop computer (PC), the user device 154*b* may comprise a laptop computer, the user device 154*c* may comprise a smartphone, and the user device 154*d* may comprise a tablet computer.

Typically a processor (e.g., one or more microprocessors, one or more microcontrollers, one or more digital signal processors) of a user device 154*a-d* or controller device 152 will receive specially programmed instructions (e.g., from a memory or like device), execute those instructions, and perform one or more processes defined by those instructions. Instructions may be embodied for example, in one or more computer programs and/or one or more scripts.

In some embodiments a controller device 152 and/or one or more of the user devices 154*a-d* stores and/or has access to data useful for providing one or more functions described in this disclosure, in a manner similar to that described with respect to system 100. In some embodiments, a controller device 152 and/or database 158 may not be necessary or desirable. For example, user devices 154*a-d* may be executing stand-alone applications (e.g., smartphone apps) and may be able to communicate with each other via network 156 (e.g., for sharing image files and/or recorded music files).

Figure 2:
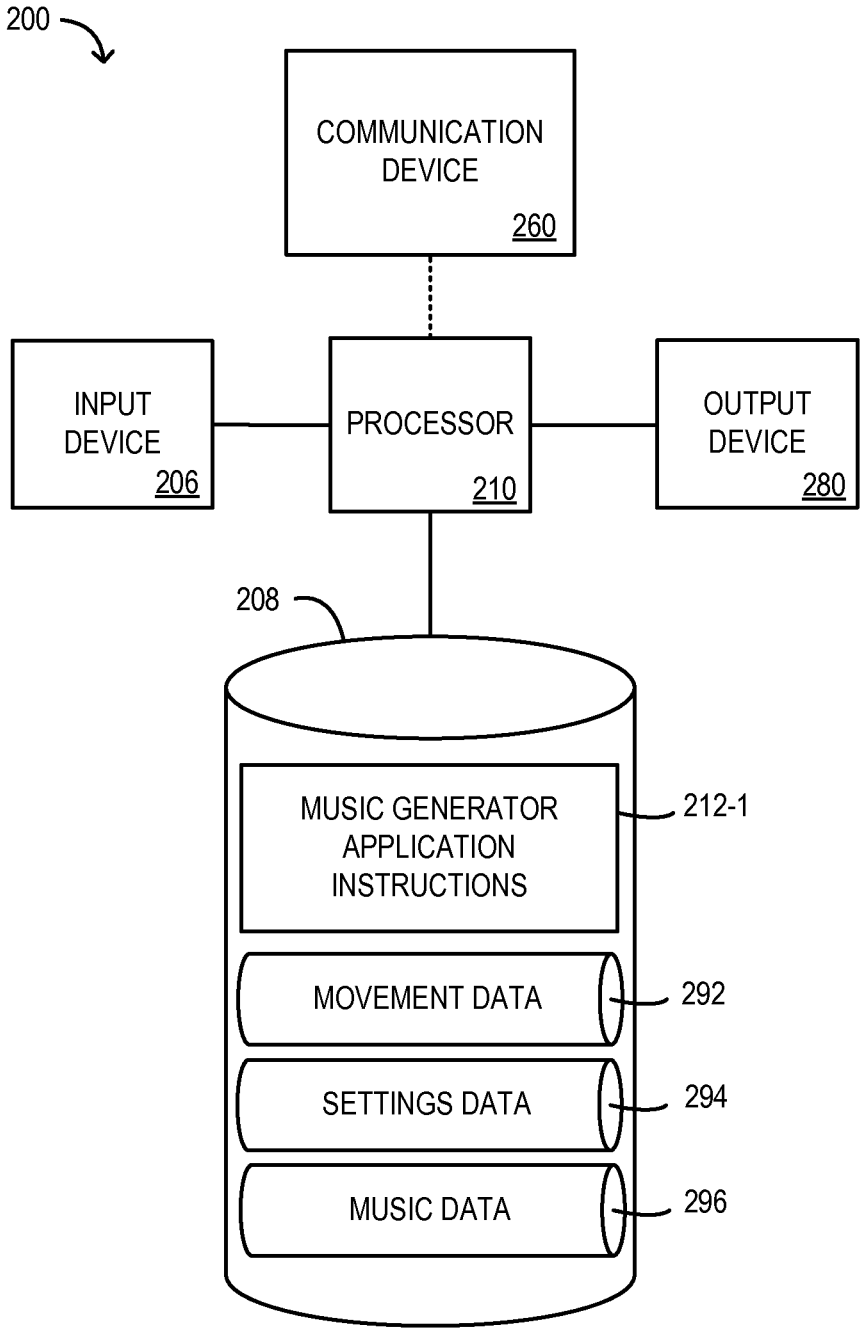
FIG. 2 is a diagram of a computing device according to some embodiments.

Turning to FIG. 2, a block diagram of an apparatus 200 according to some embodiments is shown. In some embodiments, the apparatus 200 may be similar in configuration and/or functionality to any of the user devices 104, server computer 102, and/or third-party data device 106 of FIG. 1A, and/or any of the controller device 152 and/or user devices 154*a-d* of FIG. 1B. The apparatus 200 may, for example, execute, process, facilitate, and/or otherwise be associated with any of the example processes or interfaces described in conjunction with any of the flowcharts in this disclosure.

In some embodiments, the apparatus 200 may comprise an input device 206, a memory device 208, a processor 210, a communication device 260, and/or an output device 280. Fewer or more components and/or various configurations of the components 206, 208, 210, 260, 280 may be included in the apparatus 200 without deviating from the scope of embodiments described in this disclosure.

According to some embodiments, the processor 210 may be or include any type, quantity, and/or configuration of processor that is or becomes known. The processor 210 may comprise, for example, an Intel® IXP 2800 network processor or an Intel® XEON™ processor coupled with an Intel® E7501 chipset. In some embodiments, the processor 210 may comprise multiple inter-connected processors, microprocessors, and/or micro-engines. According to some embodiments, the processor 210 (and/or the apparatus 200 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 200 comprises a server such as a blade server, necessary power may be supplied via a standard AC outlet, power strip, surge protector, and/or Uninterruptible Power Supply (UPS) device.

In some embodiments, the input device 206 and/or the output device 280 are communicatively coupled to the processor 210 (e.g., via wired and/or wireless connections and/or pathways) and they may generally comprise any types or configurations of input and output components and/or devices that are or become known, respectively.

The input device 206 may comprise, for example, a physical and/or virtual keyboard that allows an operator of the apparatus 200 to interface with the apparatus 200 (e.g., such as to enter data or compose an electronic message). The input device 206 may comprise, for example, one or more of a pointer device (e.g., a mouse), a camera, and/or a headphone jack. Input device 206 may include one or more of a keypad, touch screen, or other suitable tactile input device. Input device 206 may include a microphone comprising a transducer adapted to provide audible input of a signal that may be transmitted (e.g., to the processor 210 via an appropriate communications link).

In some embodiments, the input device 206 may comprise an accelerometer, gyroscope, compass, and/or other device, such as a three-axis digital accelerometer (e.g., ADXL345 by Analog Devices, Inc., 8134 33DH 00D35 by STMicroelectronics, Inc.), the AGD8 2135 LUSDI vibrating structure gyroscope by STMicroelectronics, Inc., and/or AK8973 electronic compass by AKM Semiconductor, Inc., configured to detect movement, tilt, and/or orientation (e.g., portrait or landscape view of a smartphone) of the device. As will be readily understood by those of skill in the art, signals from integrated and/or external accelerometers, gyroscopes, and/or compasses may be used (alone or in combination) to calculate orientation, tilt, and/or direction of a device (e.g., a mobile phone).

According to some embodiments, the speed of a user and/or a user device may be determined based on the device's accelerometer and/or the time between queries for the device's location and the distance traversed between the queries.

The output device 280 may, according to some embodiments, comprise a display screen and/or other practicable output component and/or device. Output device 280 may include one or more speakers comprising a transducer adapted to provide audible output based on a signal received (e.g., via processor 210), such as for outputting musical tones.

According to some embodiments, the input device 206 and/or the output device 280 may comprise and/or be embodied in a single device, such as a touch-screen display.

In some embodiments, the communication device 260 may comprise any type or configuration of communication device that is or becomes known or practicable. The communication device 260 may, for example, comprise a network interface card (NIC), a telephonic device, a cellular network device, a router, a hub, a modem, and/or a communications port or cable. In some embodiments, the communication device 260 may be coupled to provide data to a telecommunications device. The communication device 260 may, for example, comprise a cellular telephone network transmission device that sends signals to a server in communication with a plurality of handheld, mobile and/or telephone devices. According to some embodiments, the communication device 260 may also or alternatively be coupled to the processor 210.

Communication device 260 may include, for example, a receiver and a transmitter configured to communicate via signals according to one or more suitable data and/or voice communication systems. In some embodiments, the communication device 260 may comprise an IR, RF, Bluetooth™, and/or Wi-Fi®network device coupled to facilitate communications between the processor 210 and another device (such as one or more mobile devices, server computers, central controllers, and/or third-party data devices). For example, communication device 260 may communicate voice and/or data over mobile telephone networks such as GSM, CDMA, CDMA2000, EDGE or UMTS. Alternatively, or in addition, communication device 260 may include receiver/transmitters for data networks including, for example, any IEEE 802.x network such as WiFi or Bluetooth™.

The memory device 208 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 208 may, according to some embodiments, music generator application instructions 212-1 (e.g., as non-transitory computer-readable software code), movement data 292, settings data 294, and/or music data 296. In some embodiments, the music generator application instructions 212-1 may be utilized by the processor 210 to provide output information (e.g., via the output device 280 and/or the communication device 260 of the user devices 104 and/or 154*a-d* of FIG. 1A and FIG. 1B, respectively).

According to some embodiments, music generator application instructions 212-1 may be operable to cause the processor 210 to process movement data 292 and/or settings data 294 as described in this disclosure, for example, to generate or otherwise determine at least one chord and/or music note based on a direction of travel and/or a speed of travel (e.g., determined via a user's mobile device). In some embodiments, determined music information (e.g., music notes, melodies, and/or chords) may be stored locally and/or remotely in a music data database (e.g., music data 296).

Any or all of the exemplary instructions and data types and other practicable types of data may be stored in any number, type, and/or configuration of memory devices that is or becomes known. The memory device 208 may, for example, comprise one or more data tables or files, databases, table spaces, registers, and/or other storage structures. In some embodiments, multiple databases and/or storage structures (and/or multiple memory devices 208) may be utilized to store information associated with the apparatus 200. According to some embodiments, the memory device 208 may be incorporated into and/or otherwise coupled to the apparatus 200 (e.g., as shown) or may simply be accessible to the apparatus 200 (e.g., externally located and/or situated).

Figure 3:
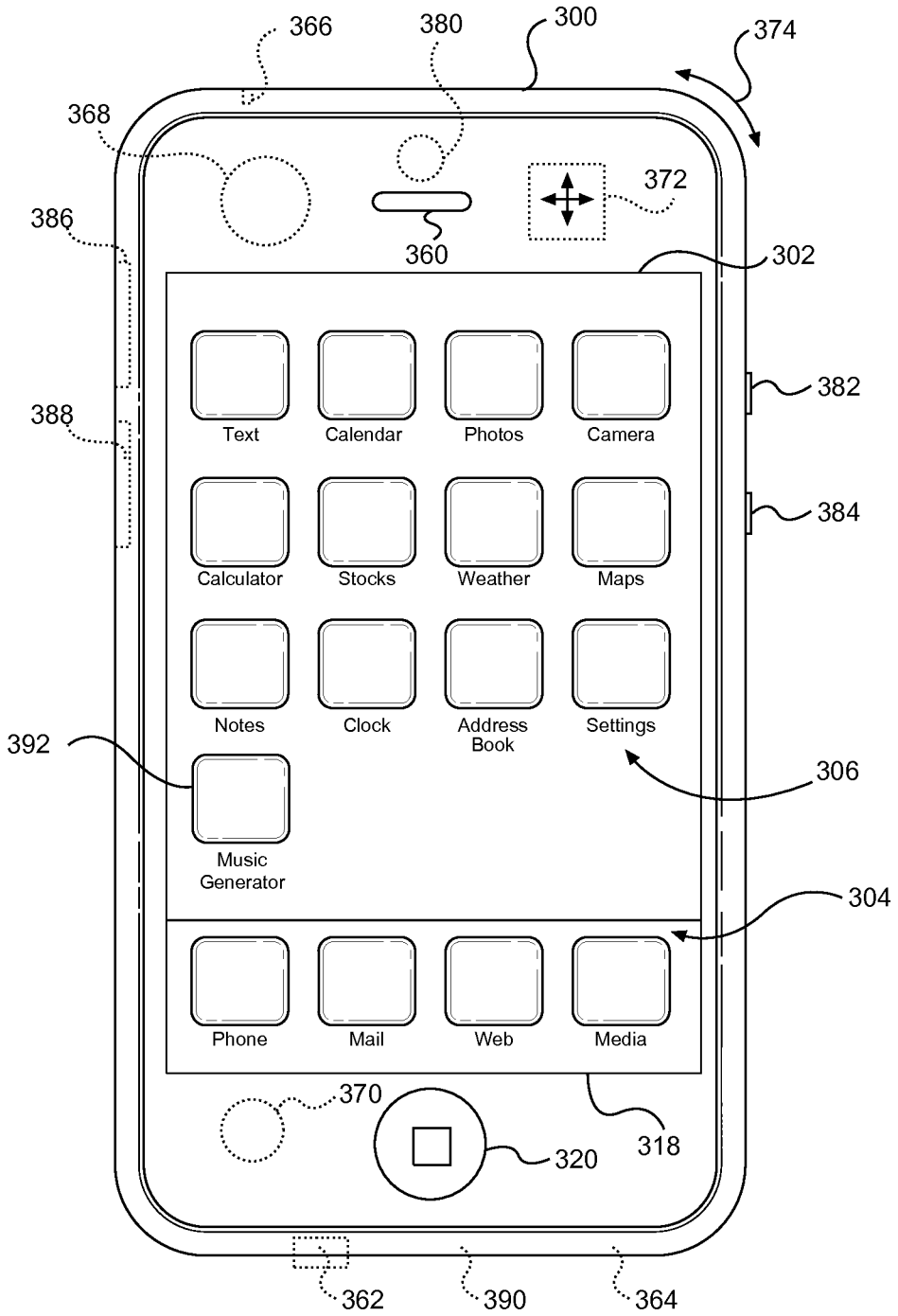
FIG. 3 is a diagram of a mobile device according to some embodiments.

Turning to FIG. 3, a block diagram of an example mobile device 300 according to some embodiments is shown. In some embodiments, the mobile device 300 comprises a touch-sensitive display 302. The touch-sensitive display may be implemented with liquid crystal display (LCD) technology, light emitting polymer display (LPD) technology, or some other display technology. The touch-sensitive display 302 may be sensitive to haptic and/or tactile contact with a user. In some embodiments, the touch-sensitive display 302 may comprise a multi-touch-sensitive display that can, for example, process multiple simultaneous touch points, including processing data related to the pressure, degree, and/or position of each touch point. Such processing facilities gestures and interactions with multiple fingers, chording, and other interactions. Alternately or in addition, other touch-sensitive display technologies may be used, such as, without limitation, a display in which contact is made using a stylus or other pointing device.

In some embodiments, the mobile device 300 may be adapted to display one or more graphical user interfaces on a display (e.g., touch-sensitive display 302) for providing the user access to various system objects and/or for conveying information to the user. In some embodiments, the graphical user interface may include one or more display objects 304, 306, such as icons or other graphic representations of respective system objects. Some examples of system objects include, without limitation, device functions, applications, windows, files, alerts, events, or other identifiable system objects.

In some embodiments, the mobile device 300 may implement multiple device functionalities, such as a telephony device, an e-mail device, a network data communication device, a Wi-Fi base station device (not shown), and a media processing device. In some embodiments, particular display objects 304 may be displayed in a menu bar 318. In some embodiments, device functionalities may be accessed from a top-level graphical user interface, such as the graphical user interface illustrated in FIG. 3. Touching one of the display objects 304 may, for example, invoke corresponding functionality. For example, touching a "Mail" display object may invoke an email application on the mobile device 300 for sending email messages.

In some embodiments, the mobile device 300 may implement network distribution functionality. For example, the functionality may enable the user to take the mobile device 300 and provide access to its associated network while traveling. In particular, the mobile device 300 may extend Internet access (e.g., Wi-Fi) to other wireless devices in the vicinity. For example, mobile device 300 may be configured as a base station for one or more devices. As such, mobile device 300 may grant or deny network access to other wireless devices.

In some embodiments, upon invocation of device functionality, the graphical user interface of the mobile device 300 changes, or is augmented or replaced with another user interface or user interface elements, to facilitate user access to particular functions associated with the corresponding device functionality. For example, in response to a user touching a phone object, the graphical user interface of the touch-sensitive display 302 may present display objects related to various phone functions; likewise, touching of an email object may cause the graphical user interface to present display objects related to various e-mail functions; touching a Web object may cause the graphical user interface to present display objects related to various Web-surfing functions; and touching a media player object may cause the graphical user interface to present display objects related to various media processing functions.

In some embodiments, the top-level graphical user interface environment or state of FIG. 3 may be restored by pressing a button 320 of the mobile device 300. In some embodiments, each corresponding device functionality may have corresponding "home" display objects displayed on the touch-sensitive display 302, and the top-level graphical user interface environment of FIG. 3 may be restored by pressing the "home" display object.

In some embodiments, the top-level graphical user interface may include display objects 306, such as a short messaging service (SMS) object and/or other type of messaging object, a calendar object, a photos object, a camera object, a calculator object, a stocks object, a weather object, a maps object, a notes object, a clock object, an address book object, a settings object, and/or one or more types of display objects having corresponding respective object environments and functionality.

A user touching the example "Music Generator" object 392 may, for example, invoke a music generation services environment, and supporting functionality, as described in this disclosure with respect to various embodiments; likewise, a selection of any of the display objects 306 may invoke a corresponding object environment and functionality.

Additional and/or different display objects may also be displayed in the graphical user interface of FIG. 3. For example, if the device 300 is functioning as a base station for other devices, one or more "connection" objects may appear in the graphical user interface to indicate the connection. In some embodiments, the display objects 306 may be configured by a user, e.g., a user may specify which display objects 306 are displayed, and/or may download additional applications or other software that provides other functionalities and corresponding display objects.

In some embodiments, the mobile device 300 may include one or more input/output (I/O) devices and/or sensor devices. For example, a speaker 360 and a microphone 362 may be included to facilitate voice-enabled functionalities, such as phone and voice mail functions. In some embodiments, an up/down button 384 for volume control of the speaker 360 and the microphone 362 may be included. The mobile device 300 may also include an on/off button 382 for a ring indicator of incoming phone calls. In some embodiments, a loudspeaker 364 may be included to facilitate hands-free voice functionalities, such as speaker phone functions. An audio jack 366 may also be included for use of headphones and/or a microphone.

In some embodiments, a proximity sensor 368 may be included to facilitate the detection of the user positioning the mobile device 300 proximate to the user's ear and, in response, to disengage the touch-sensitive display 302 to prevent accidental function invocations. In some embodiments, the touch-sensitive display 302 may be turned off to conserve additional power when the mobile device 300 is proximate to the user's ear.

Other sensors may also be used. For example, in some embodiments, an ambient light sensor 370 may be utilized to facilitate adjusting the brightness of the touch-sensitive display 302. In some embodiments, an accelerometer 372 may be utilized to detect movement of the mobile device 300, as indicated by the directional arrow 374. Accordingly, display objects and/or media may be presented according to a detected orientation, e.g., portrait or landscape. Some embodiments may provide for determining orientation and/or determining a measure of orientation (e.g., relative to North/South axes; with respect to two horizontal axes (x,y) and a vertical axis (z)), and/or determining an indication of acceleration using an inertial measurement unit, accelerometers, magnetometers, and/or gyroscopes.

In some embodiments, the mobile device 300 may include circuitry and sensors for supporting a location determining capability, such as that provided by the global positioning system (GPS) or other positioning systems (e.g., systems using Wi-Fi access points, television signals, cellular grids, Uniform Resource Locators (URLs)). In some embodiments, a positioning system (e.g., a GPS receiver) may be integrated into the mobile device 300 (e.g., embodied as a mobile type of user device, such as a tablet computer or smartphone) or provided as a separate device that may be coupled to the mobile device 300 through an interface (e.g., via communication device 260) to provide access to location-based services.

In some embodiments, a port device 390, e.g., a Universal Serial Bus (USB) port, or a docking port, or some other wired port connection, may be included in mobile device 300. The port device 390 may, for example, be utilized to establish a wired connection to other computing devices, such as other communication devices 300, network access devices, a personal computer, a printer, a display screen, or other processing devices capable of receiving and/or transmitting data. In some embodiments, the port device 390 allows the mobile device 300 to synchronize with a host device using one or more protocols, such as, for example, the TCP/IP, HTTP, UDP and any other known protocol.

The mobile device 300 may also include a camera lens and sensor 380. In some embodiments, the camera lens and sensor 380 may be located on the back surface of the mobile device 300. The camera may capture still images and/or video.

The mobile device 300 may also include one or more wireless communication subsystems, such as an 802.11b/g communication device 386, and/or a Bluetooth™ communication device 388. Other communication protocols may also be supported, including other 802.x communication protocols (e.g., WiMax, Wi-Fi, 3G), code division multiple access (CDMA), global system for mobile communications (GSM), Enhanced Data GSM Environment (EDGE), etc.

In some embodiments, the mobile device 300 may present recorded audio and/or video files, such as MP3, AAC, and MPEG files. In some embodiments, the mobile device 300 may include the functionality of an MP3 player or other type of media player. Other input/output and control devices may also be used.

Figure 4:
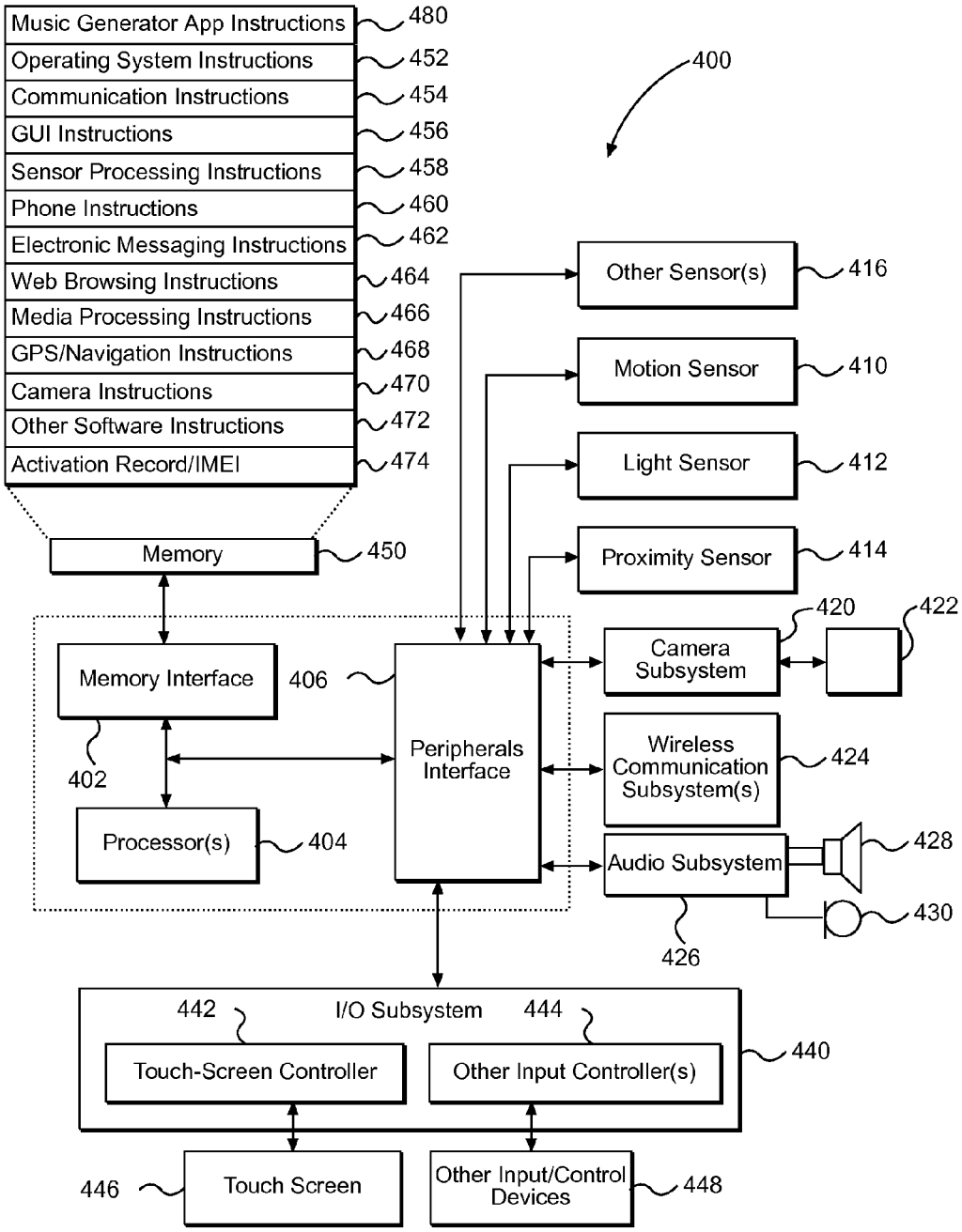
FIG. 4 is a diagram of a mobile device according to some embodiments.

FIG. 4 is a block diagram of an example architecture for the mobile device of FIG. 3. The mobile device 300 may include a memory interface 402, one or more data processors, image processors and/or central processing units 404, and a peripherals interface 406. The memory interface 402, the one or more processors 404 and/or the peripherals interface 406 may be separate components or may be integrated in one or more integrated circuits. The various components in the mobile device 300 may be coupled by one or more communication buses or signal lines.

Sensors, devices, and subsystems may be coupled to the peripherals interface 406 to facilitate multiple functionalities. For example, a motion sensor 410, a light sensor 412, and a proximity sensor 414 may be coupled to the peripherals interface 406 to facilitate the orientation, lighting, and proximity functions described with respect to FIG. 3. Other sensors 416 may also be connected to the peripherals interface 406, such as a positioning system (e.g., GPS receiver), a temperature sensor, a biometric sensor, or other sensing device, to facilitate related functionalities.

A camera subsystem 420 and an optical sensor 422, e.g., a charged coupled device (CCD) or a complementary metal-oxide semiconductor (CMOS) optical sensor, may be utilized to facilitate camera functions, such as recording photographs and video clips.

Communication functions may be facilitated through one or more wireless communication subsystems 424, which may include radio frequency receivers and transmitters and/or optical (e.g., infrared) receivers and transmitters. The specific design and embodiment of the communication subsystem 424 may depend on the communication network(s) over which the mobile device 300 is intended to operate. For example, a mobile device 300 may include communication subsystems 424 designed to operate over a GSM network, a GPRS network, an EDGE network, a Wi-Fi or WiMax network, and a Bluetooth™ network. In particular, the wireless communication subsystems 424 may include hosting protocols such that the device 300 may be configured as a base station for other wireless devices.

An audio subsystem 426 may be coupled to a speaker 428 and a microphone 430 to facilitate voice-enabled functions, such as voice recognition, voice replication, digital recording, and telephony functions.

The I/O subsystem 440 may include a touch screen controller 442 and/or other input controller(s) 444. The touch-screen controller 442 may be coupled to a touch screen 446. The touch screen 446 and touch screen controller 442 can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen 446.

The other input controller(s) 444 may be coupled to other input/control devices 448, such as one or more buttons, rocker switches, thumb-wheel, infrared port, USB port, and/or a pointer device such as a stylus. The one or more buttons (not shown) may include an up/down button for volume control of the speaker 428 and/or the microphone 430.

In one embodiment, a pressing of the button for a first duration may disengage a lock of the touch screen 446; and a pressing of the button for a second duration that is longer than the first duration may turn power to the mobile device 300 on or off. The user may be able to customize a functionality of one or more of the buttons. The touch screen 446 can, for example, also be used to implement virtual or soft buttons and/or a keyboard.

The memory interface 402 may be coupled to memory 450. The memory 450 may include high-speed random access memory and/or non-volatile memory, such as one or more magnetic disk storage devices, one or more optical storage devices, and/or flash memory (e.g., NAND, NOR). The memory 450 may store an operating system 452, such as Darwin, RTXC, LINUX, UNIX, OS X, WINDOWS, or an embedded operating system such as VxWorks. The operating system 452 may include instructions for handling basic system services and for performing hardware dependent tasks. In some embodiments, the operating system 452 may be a kernel (e.g., UNIX kernel).

The memory 450 may also store communication instructions 454 to facilitate communicating with one or more additional devices, one or more computers and/or one or more servers.

The memory 450 may include graphical user interface instructions 456 to facilitate graphic user interface processing; sensor processing instructions 458 to facilitate sensor-related processing and functions; phone instructions 460 to facilitate phone-related processes and functions; electronic messaging instructions 462 to facilitate electronic-messaging related processes and functions; web browsing instructions 464 to facilitate web browsing-related processes and functions; media processing instructions 466 to facilitate media processing-related processes and functions; GPS/Navigation instructions 468 to facilitate GPS and navigation-related processes and instructions; camera instructions 470 to facilitate camera-related processes and functions; and/or other software instructions 472 to facilitate other processes and functions, e.g., security processes and functions.

The memory 450 may also store music generator app instructions 480 for facilitating the creation of music or other types of audio output based on movement data. In some embodiments, music generator app instructions 480 allow a user to generate a music composition, review and/or select (e.g., via touch screen 446) one or more settings for generating audio output, play a music composition (e.g., via speaker 428), record a file including generated audio signals, and/or transmit audio files to at least one other user and/or remote server (e.g., via wireless communication subsystem(s) 424).

The memory 450 may also store other software instructions (not shown), such as web video instructions to facilitate web video-related processes and functions, and/or web shopping instructions to facilitate web shopping-related processes and functions. In some embodiments, the media processing instructions 466 are divided into audio processing instructions and video processing instructions to facilitate audio processing-related processes and functions and video processing-related processes and functions, respectively. An activation record and International Mobile Equipment Identity (IMEI) 474 or similar hardware identifier may also be stored in memory 450.

Each of the above identified instructions and applications may correspond to a set of instructions for performing one or more functions described above. These instructions need not be implemented as separate software programs, procedures, or modules. The memory 450 may include additional instructions or fewer instructions. Furthermore, various functions of the mobile device 300 may be implemented in hardware and/or in software, including in one or more signal processing and/or application specific integrated circuits.

Figure 5:
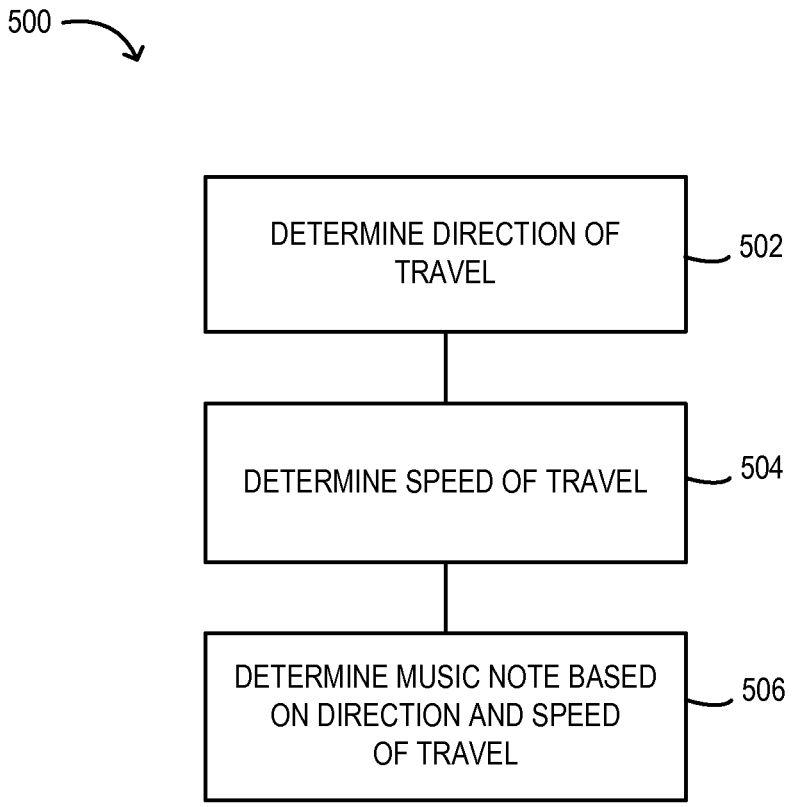
FIG. 5 is a flowchart of a method according to some embodiments.

Referring now to FIG. 5, a flow diagram of a method 500 according to some embodiments is shown. The method 500 may be described in this disclosure as being performed by a user device (e.g., a user's mobile device, such as a phone or tablet computer). However, according to some embodiments, one or more of the steps of method 500 may be performed by one computing device, while one or more other steps may be performed by another computing device. Alternatively, any and all of the steps of the described method may be performed by a single computing device, which may be a user device, server computer, or another computing device. Further, any steps described in this disclosure as being performed by a particular computing device may, in some embodiments, be performed by a human and/or a different computing device as appropriate.

According to some embodiments, the method 500 may comprise determining a direction of travel, at 502, and determining a speed of travel, at 504. Determining a direction of travel (e.g., for a user and/or a user device) may comprise one or more of: determining information about movement of a user and/or user device (e.g., a smartphone), determining location information (e.g., via one or more one GPS or other positioning systems), determining orientation information (e.g., via an accelerometer), and/or determining navigational heading information (e.g., via a compass, receiving information from a remote device). Determining a speed of travel may comprise one or more of: receiving location information (e.g., one or more GPS coordinates), determining an indication of a first position and an indication of a second position, determining a first time associated with a first location and a second time associated with a second location, determining a difference between respective times associated with each of at least two locations, determining a speed of travel based on a distance between two locations and a difference between respective times associated with each of the two locations, determining an indication of a speed of a user and/or of a user device, determining an indication of a first speed and an indication of a second speed, and/or receiving speed information (e.g., from a remote device).

The method 500 may comprise determining a music note based on a direction of travel and a speed of travel, at 506. For example, a music generator application may determine a music note based on the direction of travel determined at 502 and the speed of travel determined at 504.

In some embodiments, determining a music note may comprise determining the tone based on a tonal index and a direction value that indicates and/or is based on the direction of travel (e.g., a heading expressed as n degrees out of a possible 360 degrees). For example, an array or other data store may be established (e.g., in a music data database) that associates specific music keys, chords, and/or notes with respective direction values. In one embodiment, an index array may be established for one or more particular keys, scales, notes, and/or chord types.

Determining a music note based on a direction value and an index may comprise determining a note corresponding to a determined direction value. For example, a direction of travel of 44 degrees (e.g., where 0 degrees is due north and 90 degrees is due east, and so on) may be mapped to (e.g., as established in a database, data array, or other type of data collection) or otherwise correspond to a particular key (e.g., the key of G) and/or a particular note (e.g., a G note).

The method 500 may comprise outputting an audio signal based on the determined music value. In some embodiments, outputting an audio signal comprises sending a tone (e.g., represented as an audio frequency value in Hz) to a sound buffer for output via an audio output device (e.g., a speaker) of a user device. According to some embodiments, outputting the audio signal may comprise outputting the audio signal using a render callback function.

Alternatively, or in addition, outputting the audio signal may comprise recording a media file (e.g., to music data 296), such as an audio file (e.g., in an mp3 file format). Outputting an audio signal may comprise, for example, sharing or distributing a recorded or streamed media file to one or more users and/or for storage on a remote computing device (e.g., a central server, such as a web server, for storing and accessing user-generated content). According to some embodiments, outputting the audio signal may comprise outputting the audio signal in response to user input (e.g., a user selecting a corresponding function via a touchscreen device).

According to some embodiments, determining a music note and/or outputting an audio signal may comprise determining one or more settings, and determining a music note and/or audio signal based on the one or more settings. In some embodiments, settings may be stored, for example, in a settings database (e.g., settings data 294). In one or more embodiments, settings that may be useful in performing one or more one functions described in this disclosure may include one or more of:

- a speed at which to play notes
- available types of music to use in outputting tones (e.g., ambient, orchestral, woodwinds, drums, haunted, trumpets, etc.)
- one or more volume settings to use in determining a volume at which to play notes According to some embodiments, determining a music note may comprise determining one or more of:

- a key to use in determining music notes (e.g., A, A#, C, E, F, F#, Ab, etc.)
- a scale to use in determining music notes (e.g., major, minor, harmonic minor, pentatonic, whole tone, Ionian mode, Dorian mode, Phrygian mode, Lydian mode, Mixolydian mode, Aeloian mode, Locrian mode)
- a chord type or chord variation (e.g., Major triad, minor triad, Maj7, minor 3rd, dim 7, etc.) to use in determining one or more background chords to output In some embodiments, a particular key, scale, and/or chord type may be associated (e.g., in music data 296) with a particular direction or a plurality of different directions (e.g., a range or set of different directions).

According to some embodiments, one or more of various types of settings may be established by default for a music generator application. In some embodiments, one or more types of settings may be selected or modified by a user (e.g., via a user interface).

Figure 6:
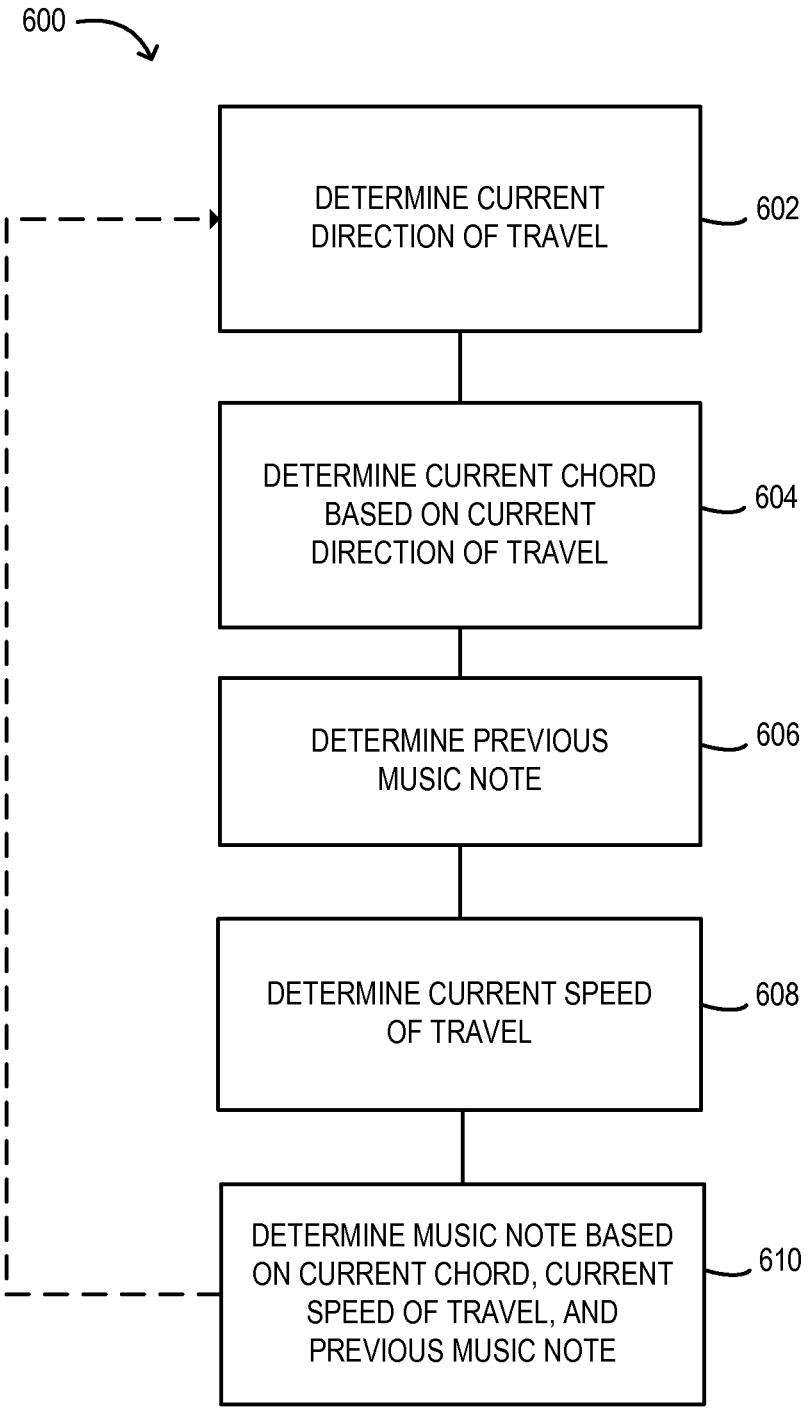
FIG. 6 is a flowchart of a method according to some embodiments.

Referring now to FIG. 6, a flow diagram of a method 600 according to some embodiments is shown. The method 600 may be described in this disclosure as being performed by a user device (e.g., a user's mobile device, such as a phone or tablet computer). However, according to some embodiments, one or more of the steps of method 600 may be performed by one computing device, while one or more other steps may be performed by another computing device. Alternatively, any and all of the steps of the described method may be performed by a single computing device, which may be a user device, server computer, or another computing device. Further, any steps described in this disclosure as being performed by a particular computing device may, in some embodiments, be performed by a human and/or a different computing device as appropriate.

According to some embodiments, the method 600 may comprise determining a current direction of travel, at 602, and determining a current chord based on the current direction of travel, at 604.

The method 600 may comprise determining a previous music note, at 606. In one example, determining a previous music may comprise identifying or otherwise determining a prior music note that was selected previously (e.g., a preceding note in a composed melody). In another example, an indication of the previous music note may be stored (e.g., in music data 296) and determining the previous music note comprises receiving or otherwise determining the stored music note. A previous music note may or may not have been played, output, transmitted, and/or included as a part of a composed melody. In some embodiments, a determined music note may not be output or played if it is not time to do so before it is time to determine another new music note (e.g., based on different movement data).

The method 600 may comprise determining a current speed of travel (e.g., of a user device), at 608. The method 600 may further comprise determining a music note based on the current chord, the speed of travel, and the previous music note, at 610.

According to some embodiments, two or more of the various steps 602, 604, 606, 608, and 610 may be performed repeatedly in a particular sequence (not necessarily the sequence indicated in FIG. 6). In other embodiments, two or more of the various steps may be performed substantially at the same time, such as by respective process threads or procedural calls executing (e.g., by a processor in accordance with software instructions) in parallel. For example, determining a current direction of travel may be repeated a plurality of times during a walk by a user, with a particular frequency (e.g., a number of executions per second), while another process, such as determining a current speed, is similarly processed over and over to determine the current speed while the user is in motion. Different processes may be repeated at different times and/or with different frequencies. In one example, movement data (e.g., speed and direction) may be determined more frequently than music notes are determined and/or more frequently than music notes are output.

Figure 7:
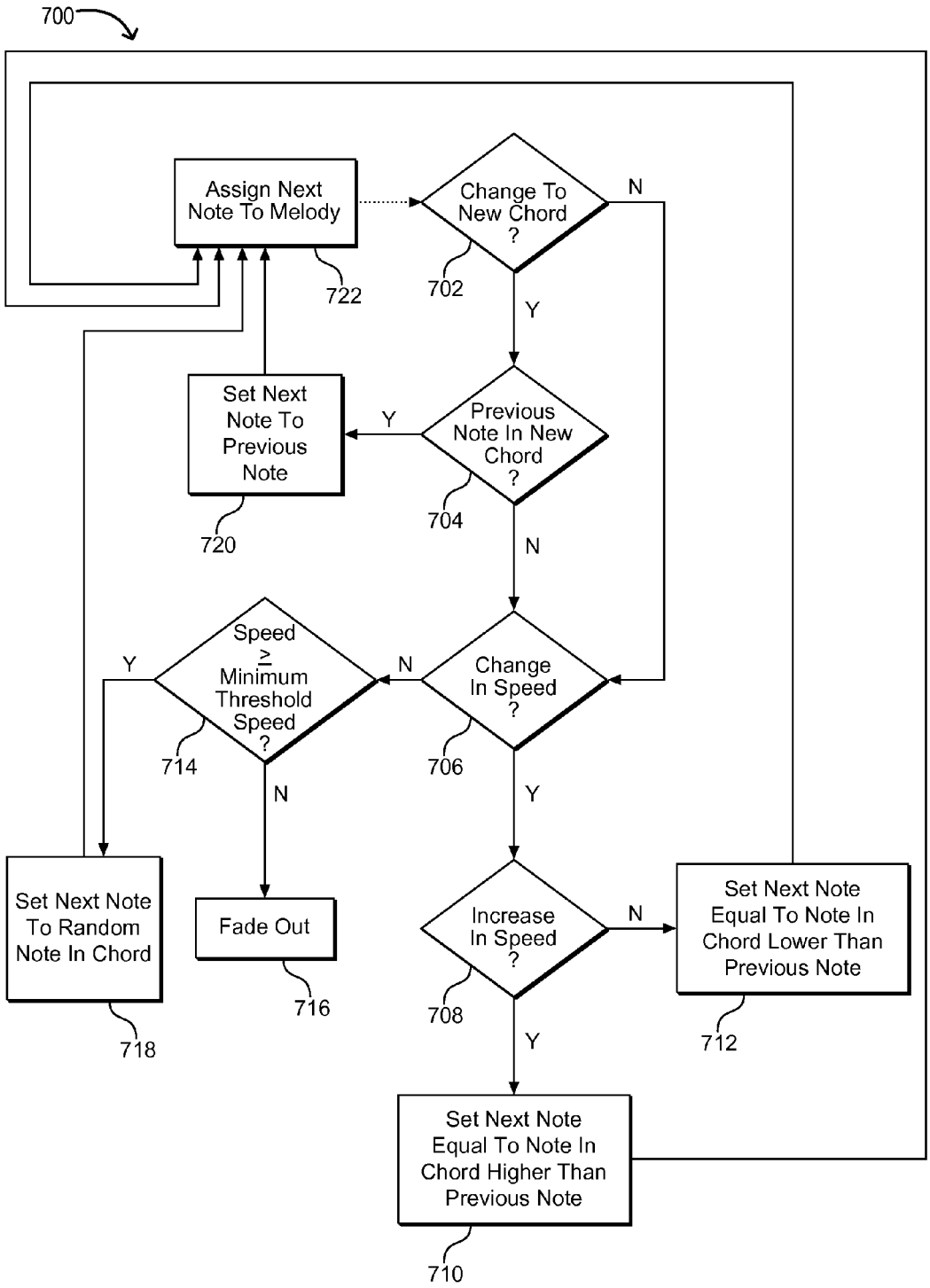
FIG. 7 is a flowchart of a method according to some embodiments.

Referring now to FIG. 7, a flow diagram of a method 700 according to some embodiments is shown. The method 700 may be described in this disclosure as being performed by a user device (e.g., a user's mobile device, such as a phone or tablet computer). However, according to some embodiments, one or more of the steps of method 700 may be performed by one computing device, while one or more other steps may be performed by another computing device. Alternatively, any and all of the steps of the described method may be performed by a single computing device, which may be a user device, server computer, or another computing device. Further, any steps described in this disclosure as being performed by a particular computing device may, in some embodiments, be performed by a human and/or a different computing device as appropriate.

According to some embodiments, the method 700 may comprise determining whether a chord (e.g., for use in playing music and/or determining one or more music notes) has changed and/or determining whether it is appropriate to change to a new chord, at 702. In one embodiment, this determination may be based on whether a direction of travel has changed (or changed at least a predetermined amount) (e.g., such as by comparing a previously determined direction of travel to a current direction of travel) such that a new key or chord will be utilized for generating music notes and/or chords. In some embodiments, determining whether a chord has changed may comprise determining a previously determined chord (e.g., by retrieving a stored indication of an earlier chord) and comparing the previously determined chord with a subsequently determined chord (e.g., a current chord based on current or more recent movement data)

If there is a new chord, the method 700 may comprise determining whether a previous note is in the new chord, at 704. In some instances, a previously played note may be in a previous chord and also in a new (different) chord. If the previous note is in the new chord, the method 700 may comprise setting the next note equal to the previous note, at 720.

If, at 702, there is no change to the chord, or if, at 704, the previous note is not in a new, different chord, the method 700 may comprise determining whether there was a change in speed, at 706. For example, a smartphone application may determine, based on previous information about a user's speed and current information about the user's speed, whether the speed has changed or not. If the speed has remained constant (no change), then the method 700 may comprise determining whether the speed is greater than or equal to a minimum threshold speed, at 714.

If the speed is less than the minimum threshold speed (e.g., the user has finished running), then the method 700 may comprise fading out any output of music, at 716. If the speed is not less than the minimum threshold speed, then the method 700 may comprise setting the next note to be a random note in the current chord (whether a newly determined or a previous, unchanged chord). In one example, a random selection is made from a predetermined set of notes of the current chord.

If, at 706, it is determined that there was a change in speed, the method 700 may comprise determining whether there was an increase in speed, at 708. If so, the next note is set to the note in the chord that is higher than the previous note (e.g., the next higher note that is in the chord), at 710. Otherwise (if there was a decrease in speed), the next note is set to the note in the chord that is the lower than the previous note (e.g., the next lower note that is in the chord), at 712.

The method 700 may comprise, after setting the next note at any of 710, 712, 718, or 720, assigning the next note to a melody, at 722. In one example, the next note is assigned to be output as the next note in a currently playing melody. In some embodiments, assigning the next note to the melody may comprise determining first whether it is time to output the next melody note. In some cases, a determined "next" note may not be output if notes are being determined faster than they are needed for output as part of a composed melody (e.g., where the frequency at which notes are played is based on a user's speed). In some embodiments, assigning the next note to a melody may comprise outputting the next note (e.g., playing the note via an audio output device).

According to some embodiments, determining a frequency for outputting audio signals, chords, and/or music notes, may comprise one or more of: determining, based on a speed of travel, a delay or time for playing chords and/or determining, based on a speed of travel, a delay or time for playing notes. In one example, if the current speed of travel is zero, then no chords are output. If the speed is greater than zero and less than a first predetermined threshold (e.g., two miles per hour), then chords may be played at a first frequency. For instance, the chords may be played relatively slowly (e.g., eight seconds for each chord). If the speed is greater than or equal to the first predetermined threshold and less than a second predetermined threshold (e.g., three miles per hour), then chords may be played more frequently (e.g., six seconds for each chord), and so on, for any desired number of potential frequency levels. Similarly, different frequencies for playing notes may be determined based on the speed of travel. For instance, if the speed is greater than zero but less than a first predetermined threshold, notes may be played once every eight seconds, with the frequency increasing to one every four seconds the speed equals or exceeds the first predetermined threshold, and so on.

According to some embodiments, determining a chord may comprise determining a chord variation within a master chord. For example, a particular chord may be associated with a plurality of variations, such as a major chord, minor chord, major $7^{th}$ chord, etc. Determining a chord based on a direction of travel may comprise determining a particular chord variation associated with a determined direction of travel and/or determining a master chord (e.g., based on directions mapped to a Circle of Fifths) and selecting a chord variation at random from the variations of the master chord.

Figure 8:
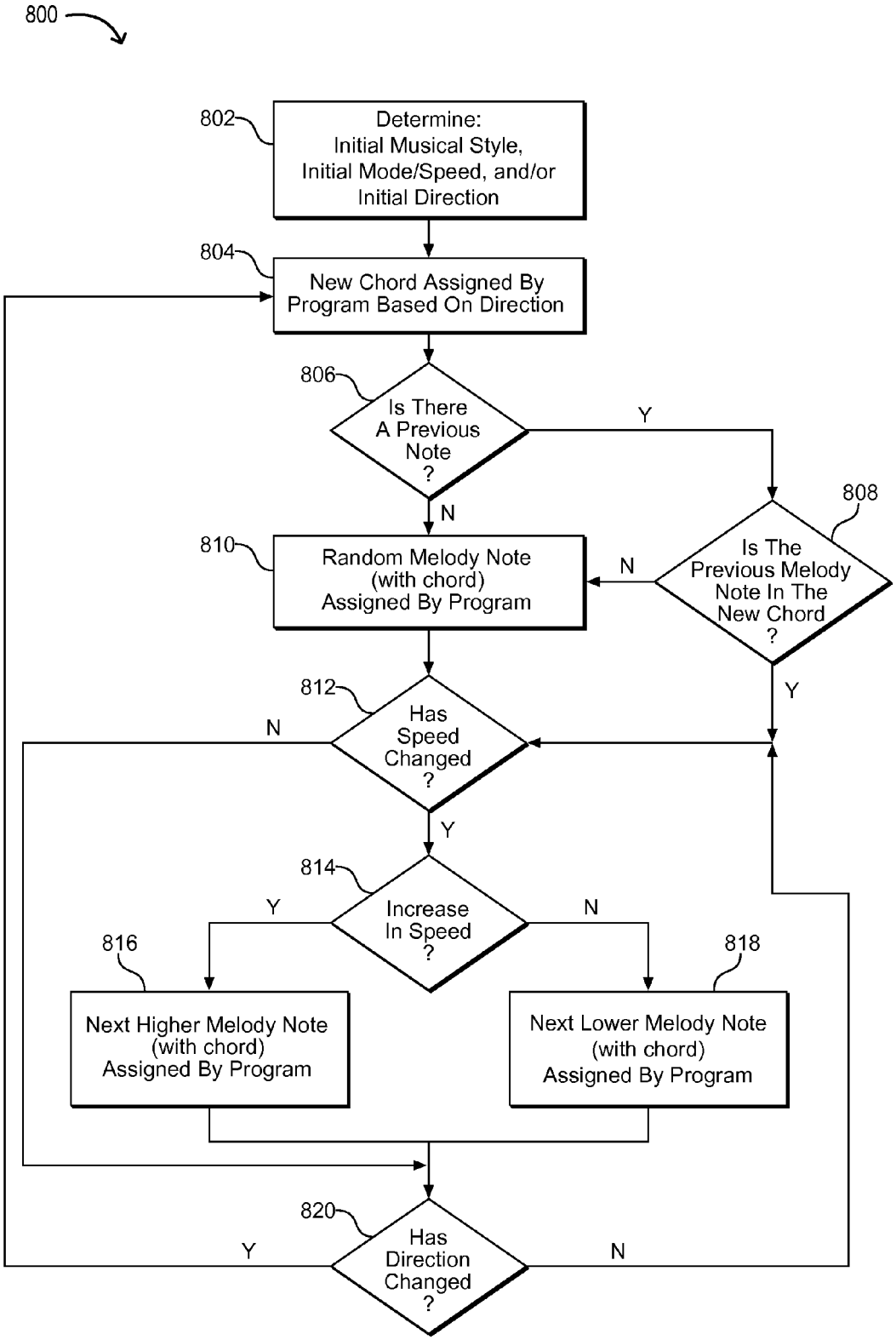
FIG. 8 is a flowchart of a method according to some embodiments.

Referring now to FIG. 8, a flow diagram of a method 800 according to some embodiments is shown. The method 800 may be described in this disclosure as being performed by a user device (e.g., a user's mobile device, such as a phone or tablet computer). However, according to some embodiments, one or more of the steps of method 800 may be performed by one computing device, while one or more other steps may be performed by another computing device. Alternatively, any and all of the steps of the described method may be performed by a single computing device, which may be a user device, server computer, or another computing device. Further, any steps described in this disclosure as being performed by a particular computing device may, in some embodiments, be performed by a human and/or a different computing device as appropriate.

According to some embodiments, the method 800 may comprise determining initial information, including one or more of an initial musical style, an initial travel mode (e.g., walking, biking, and car) and/or speed, and/or an initial direction of travel, at 802. In one embodiment, determining initial information may comprise determining a default or user setting about one or more of a musical style (e.g., a default musical style), mode or speed, and/or direction of travel. In one example, an initial direction may correspond to a first compass heading determined after initiating a music generator application (e.g., when a user starts a walk or jog).

According to some embodiments, the method 800 may comprise assigning, in accordance with the instructions of a program (e.g., a music generator application), a new chord for generating music, based on a direction of travel (e.g., an initial or later direction), at 804.

The method 800 may comprise determining if there is a previous note of a melody (e.g., if this is the first note being determined for a new music composition), at 806. If so, the method 800 may comprise determining if the previous note is in the new chord (determined at 804), at 808. If the previous note is not in the new chord, or if there is no previous note of a melody (as determined at 806), a random melody note from the new chord is assigned by the program to the melody, at 810.

According to some embodiments, if the previous note is in the new chord (as determined at 808), or after determining a random melody note at 810, the method 800 may comprise determining whether the speed (e.g., of a user and/or a user device) has changed, at 812. If the speed has not changed, the method 800 may comprise determining whether the direction of travel has changed, at 820.

If the speed (e.g., of a mobile device) has changed, the method 800 may comprise determining if there has been an increase in the speed, at 814. If so, the program assigns the next higher note (higher than a previous note) in the chord to the melody, at 816. Otherwise (if there was a decrease in speed), the program assigns the next lower note (lower than a previous note) in the chord to the melody, at 818. Following the assignment of the next higher or lower note, the method 800 may comprise determining whether the direction of travel has changed, at 820.

If the direction of travel has changed, the method 800 may comprise assigning a new chord (e.g., based on the new direction), at 804. If the direction has not changed, the method 800 may comprise determining whether the speed has changed, at 812.

Any or all of methods 500, 600, 700, and 800, and other methods described in this disclosure, may involve one or more user interface(s). One or more of such methods may include, in some embodiments, providing (e.g., by a music generator application) an interface by and/or through which a user may (i) submit one or more types of information (e.g., input user selections of settings for generating music), and/or (ii) initiate or otherwise generate music or other audio output (e.g., by touching a touch screen to initiate music generation based on a user's movement).

According to one example implementation in accordance with some embodiments, a software application for tablet computers, smartphones, and/or other types of mobile devices enables users to create a unique musical composition based upon the speed and direction of travel. In one example, a user may be composing an individualized musical composition that is based upon his or her own movements, by walking, jogging, traveling in a car, and the like. According to the example implementation, the software application running on a user device (e.g., a smartphone) can determine which direction the user is traveling, using information from a GPS receiver of the user device. For example, the user device may associate the direction the user is traveling with a specific navigational or compass heading (e.g., expressed as a particular degree heading of travel within a 360 degree range of potential headings). For example, a heading of 0 degrees may correspond to an initial heading, a heading of 90 degrees may correspond to the direction that is a full right turn relative to the initial heading, a heading of 270 degrees may correspond to the direction that is a full left turn relative to the initial heading, and a heading of 180 degrees may correspond to a full reverse in direction relative to the initial heading. In another example, the headings for 0 degrees, 90 degrees, 180 degrees, and 270 degrees may correspond, respectively, to the compass directions of north, east, south, and west. It will be readily understood that degree values, headings, compass directions, or other indications of direction of travel are not limited to those provided as examples for convenience in this disclosure.

According to the example implementation, the software application includes information for mapping an indication of a particular heading or direction of travel provided by the GPS receiver (e.g., east-northeast, 271 degrees, −63 degrees from initial line of travel) to a respective music key, chord, and/or note. In one example, a 360 degree circle may be used to define the range of potential headings, with each heading corresponding to one of at least two music keys (e.g., "C", "G", "D", "A", etc.).

In one example, music keys represented in a "Circle of Fifths" may be mapped to the 360 degrees of potential travel of a user. The Circle of Fifths is a visual, geometrical representation of the relationships among the twelve tones of the chromatic scale, their corresponding key signatures, and the associated major and minor keys. Specifically, the Circle of Fifths represents a particular sequence of pitches as a circle, each pitch being seven semitones higher than the last. In accordance with some embodiments, each of the twelve keys arranged in the Circle of Fifths may be assigned to a respective 30 degree sector of the circle, each 30 degree sector corresponding to a potential range of direction of travel of the user. For example, the key of "G" may be mapped (e.g., in a database) to travel in the range of travel corresponding to 15 to 44 degrees (e.g., relative to an initial heading). Although the Circle of Fifths, having twelve keys arranged in a particular sequence around a circle, is provided as one example, it will be readily understood that any number and/or type of music keys may be mapped to any number of ranges of potential directions (and/or specific directions) of travel, and that any such ranges may or may not be equal to one or more other ranges, as deemed desirable for a particular implementation.

Figure 9:
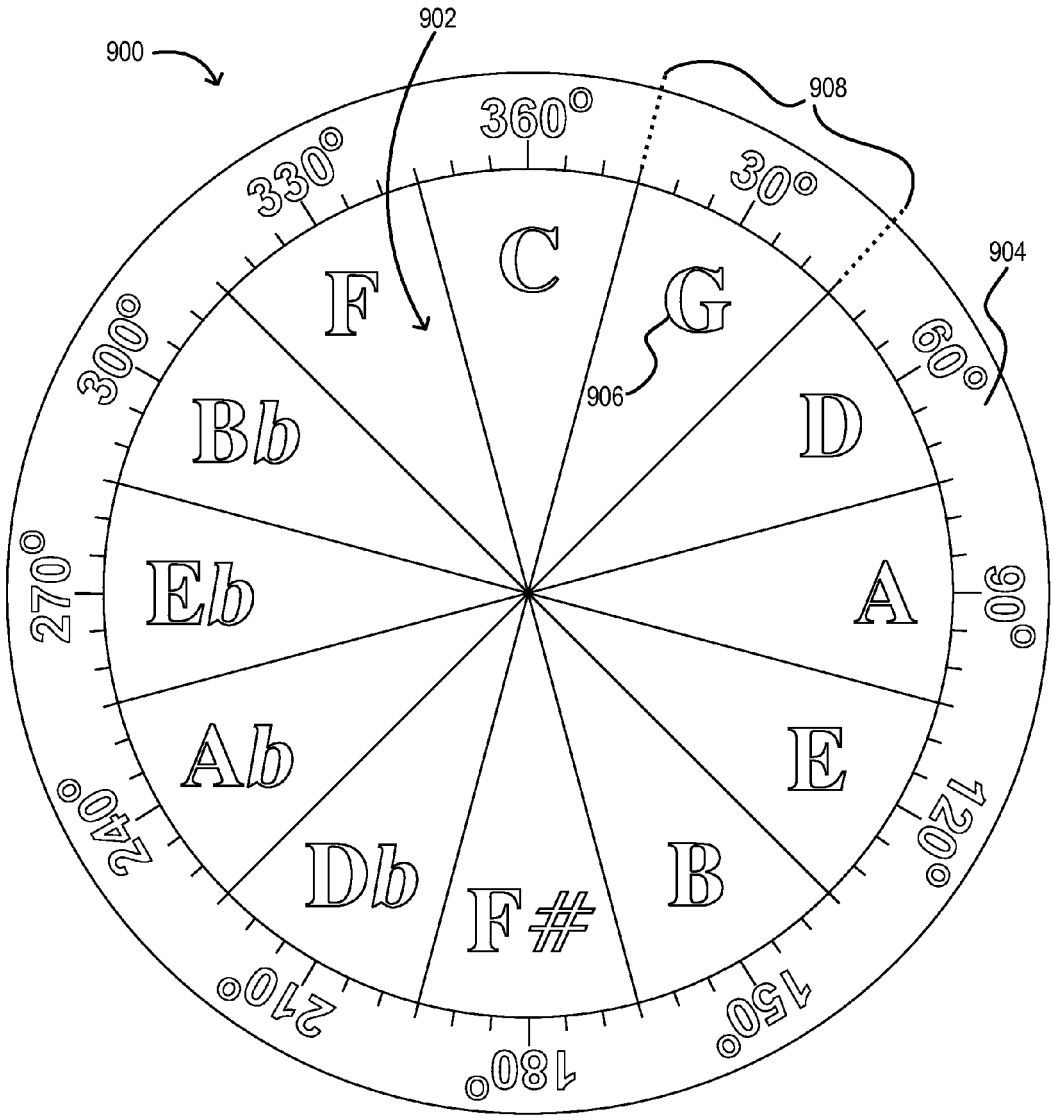
FIG. 9 is a diagram of an example correspondence between direction and musical key according to some embodiments.

FIG. 9 depicts an example representation 900 of how respective chords (arranged in accordance with a Circle of Fifths) may be associated with compass directions (or ranges of compass directions). The example representation is presented visually as a circle in FIG. 9 for purposes of illustration, but it will be readily understood that the described relationships among directions and chords may be implemented, for example, in a database or array. The representation 900 includes a Circle of Fifths 902, including a sequence of twelve chords, mapped to a compass 904. According to the example, each circle sector 908 associates a chord 906 with a corresponding 30 degree range of headings of the compass 904.

Continuing with the example software application, since each change of direction of movement based upon the scale of degrees for a circle (0 to 359 degrees) may create a chord shift, applying the Circle of Fifths (or the relationship of chords and their similarities) may create a harmonious progression of music that would be pleasing to the listener. In some embodiments, internal variations within each chord (there are 7) may be used to provide variety and/or may also be generated from smaller direction changes (e.g., ½th of a full chord movement).

In accordance with the example software application, a series of music tones (e.g., within the chord corresponding to the user's movement, or moving toward the new tones of a new chord choice) may be determined to compose melodies. In one example, the GPS receiver and/or accelerometer of a smartphone may be used to determine speed increases, speed decreases, and constant speed, and may select notes that would "fit" into the chosen chord (e.g., based on direction) to create a melody based upon speed (or footsteps). In some embodiments, the software application may create a musical melody on top of the chords (e.g., selected from the Circle of Fifths).

According to some embodiments, the example software application may allow for composing one or more different types of music (e.g., "Zen-like" sound of chords and bells, guitar melody, easy listening, soft rock, country music, classical music). In some embodiments, a user may be able to upgrade the application by paying to unlock additional music sounds or styles.

The following describes a non-limiting example, for illustrative purposes only, of an example implementation using a music generator application in accordance with one or more embodiments described in this disclosure. According to the example, a user defines his or her choice of one or more of:

music style (e.g., orchestral, jazz, big band)

mode of travel (e.g., walking, biking, car)

direction of travel (e.g., an initial direction in which the user is moving

The music generator application assigns a first chord based on a Circle of Fifths (e.g., based on the user's initial geographic direction as determined via a compass and/or positioning system). According to the example implementation, compass directions are mapped to the Circle of Fifths (e.g., north corresponds to the "C" chord).

For example, if a user is first heading north a "C" chord may be assigned, the initial melody note will be chosen from the random generation of a note (e.g., "E") that would be within all of the notes (e.g., "C", "E", "G") within the chord assigned from the Circle of Fifths (e.g., the "C" chord corresponding to the initial direction). As additional movement data is detected, the melody note may change. In one example, with an increase in speed in the same northerly direction the next highest note would be chosen from the "C" chord (e.g., a "G" note). As speed increases the next higher note in the "C" chord would be selected (e.g., "C", then "E", then "G", etc.). Alternatively, if the speed is decreasing but the user is still traveling in the same northerly direction, the next lowest note would be chosen from the "C" chord (e.g., "C"). As speed decreases the next lower notes in the "C" chord would be selected (e.g., "G", then "E", then "C", etc.). In another example, if the user maintains the same speed in the same northerly direction, a random note within the chord may be selected. In another example, if the user stops moving, and no speed is detected, the chord and notes currently playing will fade out.

In another example, if the user turns to the right and is now heading north northeast (e.g., at the same speed), the chord would shift to "G" and the previous note (e.g., "G" in the "C" chord) would move towards the closest note in the "G" chord. In this case, the note would stay a "G" because "G" is in the "G" chord. If the user's path continues to bend to the right (e.g., to a northeast direction), the chord would change to "D". Since there is no "G" note in the "D" chord, a new note would be selected (e.g., based on speed, as discussed above). If the speed becomes slightly faster, an "A" would be selected; if the speed was slightly slower, an "F#" would be selected. If there is no change in speed, then a new random note would be chosen from the "D" chord, starting another melody thread. If the user stops moving, and no speed is detected, the chord would remain in "D" and the note would remain an "A" or "F#" and would eventually fade out.

Figure 10:
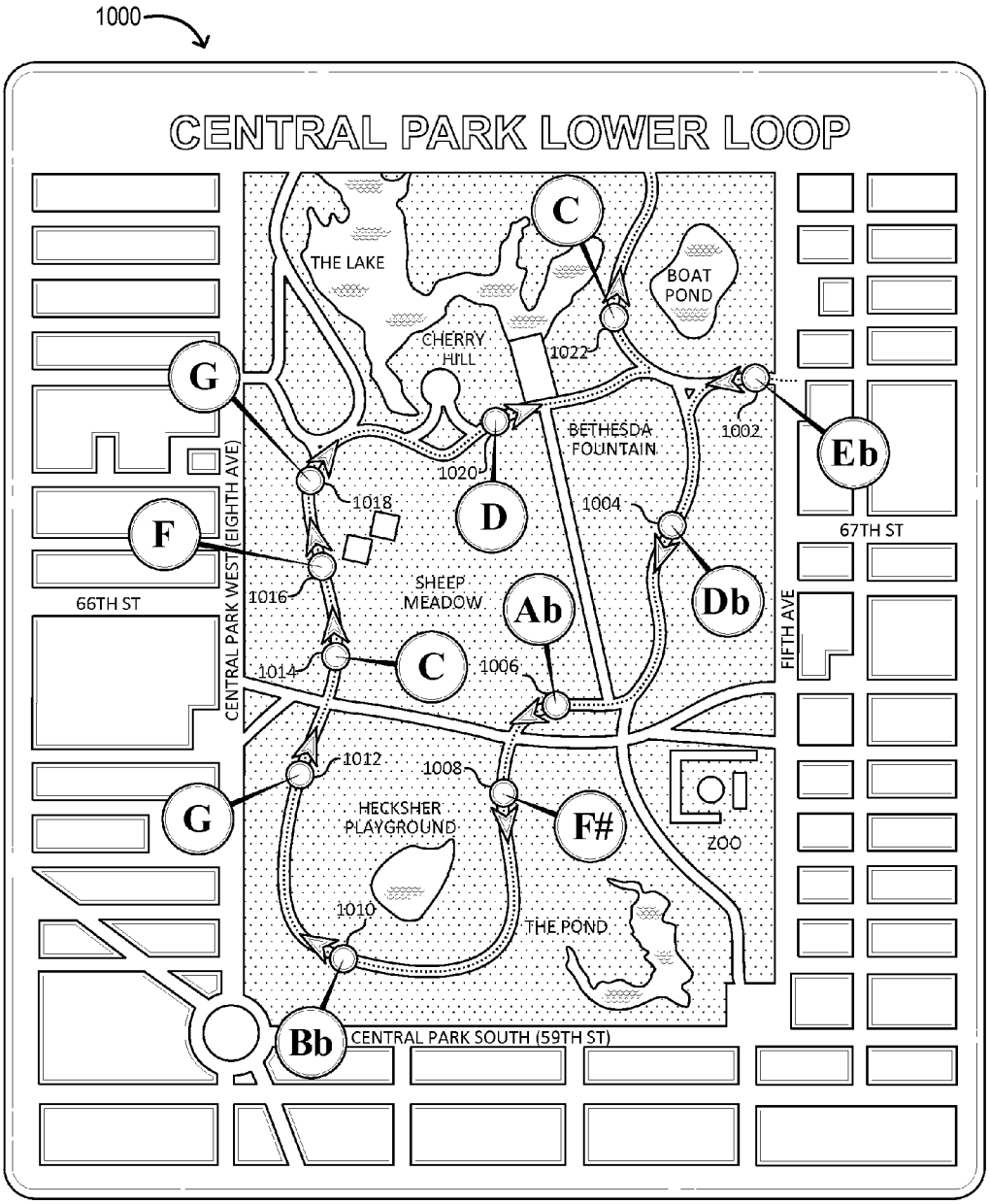
FIG. 10 is an example representation of music composition corresponding to a user's movement according to some embodiments.

FIG. 10 illustrates an example representation 1000 of music composition based on movement data associated with an example of a user cycling through a park. As discussed in this disclosure, music composition may be provided in accordance with instructions for a music generator application executed by a mobile device (e.g., smartphone) or other type of computing device (e.g., a tablet computer). Directions of travel and the corresponding respective chords determined for music generation are depicted at points 1002, 1004, 1006, 1008, 1010, 1012, 1014, 1016, 1018, 1020, and 1022 along the user's path of travel. In one example, the user's initial direction at point 1002 may be determined by the music generator application based on information received from a positioning system and/or compass, and, according to an index mapping directions to chords (e.g., as stored in music data 296), the music generator application may determine that the initial direction corresponds to the "Eb" chord (e.g., in accordance with the Circle of Fifths representation 900). In another example, the direction the user is cycling at point 1012 corresponds to the "G" chord. As discussed with respect to various embodiments, the music generator application may determine and output one or more music notes based on the different chords determined as the user continues along his bicycle ride.

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention may be practiced with various modifications and alterations, such as structural, logical, software, and/or electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features that must be present in all embodiments.

Neither the Title (set forth at the beginning of the first page of this disclosure) nor the Abstract (set forth at the end of this disclosure) is to be taken as limiting in any way the scope of the disclosed invention(s).

Throughout the description and unless otherwise specified, the following terms may include and/or encompass the example meanings provided below. These terms and illustrative example meanings are provided to clarify the language selected to describe embodiments both in the specification and in the appended claims, and accordingly, are not intended to be limiting.

The phrase "based on" does not mean "based only on", unless expressly specified otherwise. In other words, the phrase "based on" describes both "based only on" and "based at least on".

As used in this disclosure, a "user" may generally refer to any individual and/or entity that operates a user device.

Some embodiments may be associated with a "user device" or a "network device". As used in this disclosure, the terms "user device" and "network device" may be used interchangeably and may generally refer to any device that can communicate via a network. Examples of user or network devices include a personal computer (PC), a workstation, a server, a printer, a scanner, a facsimile machine, a copier, a personal digital assistant (PDA), a storage device (e.g., a disk drive), a hub, a router, a switch, and a modem, a video game console, or a wireless phone. User and network devices may comprise one or more communication or network components.

Some embodiments may be associated with a "network" or a "communication network". As used in this disclosure, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. In some embodiments, networks may be hard-wired, wireless, virtual, neural, and/or any other configuration or type of network that is or becomes known. Networks may comprise any number of computers and/or other types of devices in communication with one another, directly or indirectly, via a wired or wireless medium such as the Internet, LAN, WAN or Ethernet (or IEEE 802.3), Token Ring, RF, cable TV, satellite links, or via any appropriate communications means or combination of communications means. In some embodiments, a network may include one or more wired and/or wireless networks operated in accordance with any communication standard or protocol that is or becomes known or practicable. Exemplary protocols for network communications include but are not limited to: the Fast Ethernet LAN transmission standard 802.3-2002® published by the Institute of Electrical and Electronics Engineers (IEEE), Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Communication between and/or among devices may be encrypted to ensure privacy and/or prevent fraud in any one or more of a variety of ways well known in the art.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

As used in this disclosure, the terms "information" and "data" may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

In addition, some embodiments described in this disclosure are associated with an "indication". The term "indication" may be used to refer to any indicia and/or other information indicative of or associated with a subject, item, entity, and/or other object and/or idea. As used in this disclosure, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

"Determining" something may be performed in a variety of manners and therefore the term "determining" (and like terms) includes calculating, computing, deriving, looking up (e.g., in a table, database or data structure), ascertaining, recognizing, and the like.

A "processor" means any one or more microprocessors, Central Processing Unit (CPU) devices, computing devices, microcontrollers, digital signal processors, or like devices. Examples of processors include, without limitation, Intel's Pentium, AMD's Athlon, or Apple's A6 processor.

When a single device or article is described in this disclosure, more than one device or article (whether or not they cooperate) may alternatively be used in place of the single device or article that is described. Accordingly, the functionality that is described as being possessed by a device may alternatively be possessed by more than one device or article (whether or not they cooperate). Where more than one device or article is described in this disclosure (whether or not they cooperate), a single device or article may alternatively be used in place of the more than one device or article that is described. For example, a plurality of computer-based devices may be substituted with a single computer-based device. Accordingly, functionality that is described as being possessed by more than one device or article may alternatively be possessed by a single device or article. The functionality and/or the features of a single device that is described may be alternatively embodied by one or more other devices that are described but are not explicitly described as having such functionality and/or features. Thus, other embodiments need not include the described device itself, but rather may include the one or more other devices that would, in those other embodiments, have such functionality/features.

A description of an embodiment with several components or features does not imply that any particular one of such components and/or features is required. On the contrary, a variety of optional components are described to illustrate the wide variety of possible embodiments of the present invention(s). Unless otherwise specified explicitly, no component and/or feature is essential or required.

Further, although process steps, algorithms or the like may be described or depicted in a sequential order, such processes may be configured to work in one or more different orders. In other words, any sequence or order of steps that may be explicitly described or depicted does not necessarily indicate a requirement that the steps be performed in that order. The steps of processes described in this disclosure may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications, does not imply that the illustrated process or any of its steps is necessary to the invention, and does not imply that the illustrated process is preferred.

It will be readily apparent that the various methods and algorithms described in this disclosure may be implemented by, e.g., appropriately- and/or specially-programmed general purpose computers and/or computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer-readable media) in a number of manners. In some embodiments, hard-wired circuitry or custom hardware may be used in place of, or in combination with, software instructions for implementation of the processes of various embodiments. Thus, embodiments are not limited to any specific combination of hardware and software.

Accordingly, a description of a process likewise describes at least one apparatus for performing the process, and likewise describes at least one computer-readable medium and/or computer-readable memory for performing the process. The apparatus that performs a described process may include components and/or devices (e.g., a processor, input and output devices) appropriate to perform the process. A computer-readable medium may store program elements and/or instructions appropriate to perform a described method.

The term "computer-readable medium" refers to any medium that participates in providing data (e.g., instructions or other information) that may be read by a computer, a processor, or a like device. Various forms of computer-readable media may be involved in carrying data, including sequences of instructions, to a processor. For example, sequences of instruction (i) may be delivered from RAM to a processor, (ii) may be carried over a wireless transmission medium, and/or (iii) may be formatted according to any one or more of various known formats, standards, or protocols (some examples of which are described in this disclosure with respect to communication networks).

Computer-readable media may take many forms, including but not limited to, non-volatile media, volatile media, and transmission media. Non-volatile media may include, for example, optical or magnetic disks and other types of persistent memory. Volatile media may include, for example, DRAM, which typically constitutes the main memory for a computing device. Transmission media may include, for example, coaxial cables, copper wire, and fiber optics, including the wires that comprise a system bus coupled to the processor. Transmission media may include or convey acoustic waves, light waves, and electromagnetic emissions, such as those generated during RF and IR data communications. Common forms of computer-readable media include, for example, a floppy disk, a flexible disk, a hard disk, magnetic tape, any other magnetic medium, a CD-ROM, DVD, any other optical medium, a punch card, paper tape, any other physical medium with patterns of holes, a RAM, a PROM, an EPROM, a FLASH-EEPROM, a Universal Serial Bus (USB) memory stick or thumb drive, a dongle, any other memory chip or cartridge, a carrier wave, or any other medium from which a computer can read.

The term "computer-readable memory" may generally refer to a subset and/or class of non-transitory computer-readable medium that does not include intangible or transitory signals, waves, waveforms, carrier waves, electromagnetic emissions, or the like. Computer-readable memory may typically include physical, non-transitory media upon which data (e.g., instructions or other information) are stored, such as optical or magnetic disks and other persistent memory, DRAM, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, USB devices, any other memory chip or cartridge, and the like.

Where databases are described, it will be understood by one of ordinary skill in the art that (i) alternative database structures to those described may be readily employed, and (ii) other memory structures besides databases may be readily employed. Any illustrations or descriptions of any sample databases presented in this disclosure are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries may be different from those described in this disclosure. Further, despite any depiction of the databases as tables, other formats (including relational databases, object-based models, hierarchical electronic file structures, and/or distributed databases) could be used to store and/or manipulate the described data. Likewise, object methods or behaviors of a database may be used to implement one or more of various processes, such as those described in this disclosure. In addition, the databases may, in a known manner, be stored locally and/or remotely from a device that accesses data in such a database. Furthermore, while unified databases may be contemplated, it is also possible that the databases may be distributed and/or duplicated amongst a variety of devices.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A method, comprising:

determining a direction of travel of a mobile device comprising at least one processor;

determining a chord based on the direction of travel;

determining a previously determined music note;

determining a current speed of travel of the mobile device;

determining, by the mobile device, a music note based on the chord, the previously determined music note, and the current speed of travel; and outputting, by the mobile device, an audio signal based on at least one of the music note and the chord.

2. The method of claim 1, wherein determining the direction of travel comprises:

receiving, via a positioning system, at least one of the following:

location information, and
compass heading information.

3. The method of claim 1, further comprising:
associating each of a plurality of directions of travel with at least one of:
a respective music key, and
a respective chord.

4. The method of claim 3, wherein associating each of the plurality of directions of travel comprises:
associating each of a sequence of twelve music keys with a respective compass heading range, wherein the sequence is based on a Circle of Fifths.

5. The method of claim 1, wherein determining the chord based on the direction of travel comprises:
receiving an indication of at least one of:
a music key stored in association with the direction of travel, and
a chord stored in association with the direction of travel.

6. The method of claim 1, wherein determining the previously determined music note comprises:
receiving a stored indication of the previously determined music note.

7. The method of claim 1, wherein determining the current speed of travel comprises:
receiving an indication of the current speed of travel via an accelerometer.

8. The method of claim 1, further comprising:
determining a previously determined speed of travel of the mobile device; and
determining, based on the current speed of travel and the previously determined speed of travel, a change in speed.

9. The method of claim 8, wherein determining the music note comprises:
performing one of:
setting the music note to be a first note from the chord if the change in speed indicates an increase in speed, or
setting the music note to be a second note from the chord if the change in speed indicates a decrease in speed, wherein the second note is different from the first note.

10. The method of claim 8, wherein determining the music note comprises:
performing one of:
setting the music note to be the next note higher than the previously determined music note in the chord if the change in speed indicates an increase in speed of the mobile device, or
setting the music note to be the next note lower than the previously determined music note in the chord if the change in speed indicates a decrease in speed of the mobile device.

11. The method of claim 1,
wherein determining the chord based on the direction of travel comprises:
determining a current chord that is different from a previously determined chord; and
wherein determining the music note comprises:
determining that the previously determined music note is in the current chord; and
setting the music note to be the same as the previously determined music note.

12. The method of claim 1, wherein determining the music note comprises:
determining that the previously determined music note is not in the chord; and
selecting the music note at random from the chord.

13. The method of claim 12, further comprising:
determining that the current speed of travel is not less than a predetermined minimum threshold speed.

14. The method of claim 1, further comprising:
determining a frequency for outputting audio signals based on the current speed of travel.

15. The method of claim 14, wherein outputting the audio signal comprises:
outputting the audio signal in accordance with the determined frequency for outputting audio signals.

16. The method of claim 1, further comprising:
receiving an indication of an initial speed of travel of the mobile device;
receiving an indication of an initial direction of travel of the mobile device;
determining an initial chord based on the initial direction of travel of the mobile device, wherein the initial chord is different from the determined chord;
determining an initial note that is in the initial chord;
determining a musical style for outputting music notes;
determining, based on the current speed of travel and the initial speed of travel of the mobile device, a change in speed of the mobile device;
determining a frequency for outputting audio signals based on the current speed of travel;
wherein determining the music note based on the chord, the previously determined music note, and the speed of travel comprises:
determining the music note based on whether the initial note is in the chord and whether the change in speed of the mobile device indicates an increase in speed, a decrease in speed, or a constant speed of the mobile device; and
wherein outputting the audio signal comprises:
outputting the audio signal based on the music note, the musical style, and the frequency for outputting audio signals.

17. An apparatus comprising:
a processor;
a computer readable storage device in communication with the processor, the computer readable storage device storing instructions configured to direct the processor to perform:
determining a direction of travel of a mobile device comprising at least one processor;
determining a chord based on the direction of travel;
determining a previously determined music note;
determining a speed of travel of the mobile device;
determining a music note based on the chord, the previously determined music note, and the speed of travel; and
outputting an audio signal based on at least one of the music note and the chord.

18. A computer readable storage device storing instructions that when executed by a processing device result in:
determining, by a mobile device comprising at least one processor, a direction of travel of the mobile device;
determining a chord based on the direction of travel;
determining a previously determined music note;
determining a speed of travel of the mobile device;
determining a music note based on the chord, the previously determined music note, and the speed of travel; and
outputting an audio signal based on at least one of the music note and the chord.

19. A method comprising:
determining a speed of travel of a mobile device;

determining a direction of travel of the mobile device;

determining, based on the speed of travel and the direction of travel, a next music note to output;

determining, based on the speed of travel, a time to output the next music note; and outputting an audio signal comprising the next music note at the time to output the next music note.

20. The method of claim 19, wherein determining the next music note comprises:

determining a first next music note to output; and further comprising:

determining that it is not time to output the next music note;

after determining that it is not time to output the next music note, determining a second next music note to output; and wherein outputting the audio signal comprises:

outputting an audio signal comprising the second next music note.

* * * * *